US006029794A

United States Patent [19]

Tamaki

[11] Patent Number: 6,029,794

[45] Date of Patent: Feb. 29, 2000

[54] COIN-SENDING DEVICE

[75] Inventor: Masami Tamaki, Tokyo, Japan

[73] Assignee: Aruze Co., Ltd., Tokyo, Japan

[21] Appl. No.: 09/079,178

[22] Filed: May 15, 1998

[30] Foreign Application Priority Data

Oct. 16, 1997 [JP] Japan ..... 9-283292

[51] Int. Cl.[7] ..... G07D 5/02

[52] U.S. Cl. ..... 194/338; 453/12; 453/34; 453/57

[58] Field of Search ..... 453/3, 4, 12, 13, 453/17, 57, 34; 194/343, 338; 463/16, 25; 273/138.2

[56] References Cited

U.S. PATENT DOCUMENTS 4,558,712 12/1985 Sentoku et al. ..... 453/3
5,707,060 1/1998 Ogane et al. ..... 273/138.2

FOREIGN PATENT DOCUMENTS 0021567 1/1981 European Pat. Off. ..... 453/13
2-57284 2/1990 Japan .
6-73563 9/1994 Japan .

*Primary Examiner*—F. J. Bartuska
*Attorney, Agent, or Firm*—Bacon & Thomas

[57] ABSTRACT

A coin-sending device wherein coins can be lined up and discriminated at the same place, limitation of inner spaces of game machines or the like in which the coin-sending device is incorporated can be mitigated, and enlargement and complexity of their structures can be prevented, the coin-sending device comprising a coin-selection part 4 on a forcible-transfer passage 20 where a transfer force of a rotary disc 3 acts on coins sent from the rotary disc, coins are sent sequentially one by one to a second-side passage 2 following drive of the rotary disc 3, false coins IM at the coin-selection part 4 are removed through a removal opening 40 and only true coins are picked up at the coin-selection part 4, whereby coins are lined up and discriminated at the same place where the rotary disc 3 is provided, so that difference of height between an inlet of lump-insertion for coins and an outlet 202 of coins after discriminated can be made smaller, limitation of inner spaces of game machines or the like for mounting the coin-sending device can be mitigated without enlargement and complexity of the structures.

20 Claims, 16 Drawing Sheets

A sectional view taken in the line T – T in Fig.13.

A sectional view taken in the line N – N in Fig.13.

COIN-SENDING DEVICE

DETAILED DESCRIPTION OF THE INVENTION

1. Field of the Invention

The present invention relates to a coin-sending device which is applied in various types of game machines (such as a "pachinko" type of slot machine called or romanized as "Patisuro" and having rotatable reels, and the conventional slot machines and pachinko machines, etc.), various vending machines provided everywhere, automatic money-transfer machines and coin-discrimination machines used for example in banks, or the like, so that coins (including special metal discs called "medals" and usual coins usable for those machines) inserted in a lump in the machines are each sent one by one sequentially to a predetermined process.

2. Prior Art

A most typical and normal type of coin slot J of the pachinko type of slot machine P is, as disclosed in Examined Japanese Patent Application No. Hei 6-73563 (1994) and as shown in FIG. 23 annexed hereto, provided in the form of a slit-shaped opening into which each of coins M can be put one by one, so that players place coins into the slot one by one by their hands. Inserting coins one by one is troublesome for the players. But coins inserted are received by the machine one by one sequentially and sent to the further stages. Thus, a coin-selection (or discrimination) device C1 for determining true and false coins may be provided purposively at a point on an initial stage in the coin-sending course corresponding to the direction of the pull of gravity and above the coin-payout device H.

To mitigate the trouble of players inserting coins one by one, some machines recently given attention use a wide tray W for inserting coins in one lump, so that players can place a number of coins M all together into the machine at a time. The lump-insertion tray w exemplified in FIG. 23 showing the aforesaid Japanese publication is used jointly together with the coin slot J that is for inserting coins one by one. Coins M inserted in a lump from the wide tray W need to be first lined and sent one by one sequentially by a coin-sending device F. which provided below the wide tray W in the direction of the pull of gravity, to a coin-selection (or discrimination) device C2 disposed under the coin-sending device F in the direction of the pull of gravity and above the coin-payout device H.

In FIG. 23, K designates a panel by the rotatable reels, O a coin-payout opening, E a payout tray, and N1 a coin-sensor disposed under the coin slot J and N2 a coin-sensor on a coin-passage extended from the coin-sending device F.

In the feature having the lump-insertion tray W, the coin-sending device F is to be additionally provided with respect to the coin-selection device C2. It results in such problem that the lump-insertion tray W is to be formed as higher in position than the coin slot J, i.e., at the upper part of the panel K. This is because receiving, paying out and selecting coins are performed by use of gravity and a drop or fall from the inlet of the coin-insertion part to the coin-payout device is to be fully ensured so as to enable coins to sequentially flow smoothly in the machine from the upper part to the lower part. Hence, it is not easy but troublesome for players sitting on the seats in front of the game machines to place coins in the lump-insertion tray W, and this countermeasure for mitigating the trouble of players inserting coins one by one becomes useless or futile.

It is possible to provide the lump-insertion tray W at the same height as the coin slot J that is for inserting coins one by one, as shown in Unexamined Japanese Patent Application No. Hei 2-57284 (1990). In this case, a drop from the lump-insertion tray W to the coin-payout device H cannot be sufficiently obtained , leading to such separate problems that the coin-passage is stopped up or jammed by coins and a coin-reservoir bucket in the coin-payout device H is to be reduced in size.

Moreover, since the coin-selection device C2 and the coin-sending device F are provided separately from each other, there are required a larger number of parts to that extent and a higher cost to produce, and an additional passage connecting the coin-sending device F and the coin-selection device C2, thereby causing the whole machine to be complex in structure and larger in size, leading to a problem of loss of space.

BRIEF DESCRIPTION OF THE INVENTION

The main object of the present invention is to provide a coin-sending device which enables coins to be w ell lined up and discriminated at the same point, so that the coin-sending device when mounted in the foregoing various machines mitigates the problem of restriction of available inner spaces of the machines for mounting the coin-sending device, and there causes no problems of enlargement and complexity of the machine structures.

The invention set forth in claim 1 does, for achieving the main object, provide a coin-sending device which comprises as shown in FIGS. 3 and 4 a first-side reservoir 1 for receiving and keeping a number of coins M and a rotary disc 3 for sending the stored coins M sequentially one by one to a second-side passage 2, the second-side passage 2 including as shown in FIGS. 11 and 12 a forcible-transfer passage 20 in which a transfer force of the rotary disc 3 acts on coins M sent, and on which passage 20 is provided a coin-selection part 4 which determines or discriminates true and false coins M and causes false coins IM to be removed from the passage 2. In this case, the forcible-transfer passage 20 may be formed partially on the second-side passage 2 other than on the whole thereof as shown. And false coins IM are removed from the second-side passage 2, for example, by falling or the like.

The invention set forth in claim 2 is a coin-sending device provided as shown in FIG. 16 with a true-coin sensor 5 for detecting true coins TM which have passed the coin-selection part 4, so that such processes after discrimination that true coins after discrimination are counted and passing or non-passing of true coins is recognized can be performed accurately without errors.

The invention set forth in claim 1 is a coin-sending device wherein the second-side passage 2 does, as shown in FIGS. 11 and 12, include an arcuate passage 200 extending along the outer periphery of the rotary disc 3 and the rotary disc 3 adjacent to the passage 200 is provided on the rear surface with a coin-transfer means 30 to contact with coins M, so that transfer of coins on the second-side passage 2 is smooth and discrimination of coins at the coin-selection part 4 is carried out excellently.

The invention set forth in claim 3 is a coin-sending device wherein the second-side passage 2 includes as shown in FIG. 6 a recess 201 which is formed between a base member 21 and a cover member 22 layered thereon and has a depth enough to receive thickness of coin M, so that the whole device is simple in structure and flat or smaller in height. The base member 21 and cover member 22 may be layered directly to each other or have an intermediate member interposed between them.

The invention set forth in claim 4 is a coin-sending device wherein the coin-selection part 4 does, as shown in FIG. 13, comprise a removal opening 40 smaller in width than diameter of true coins TM for removing coins, and a pair of coin-supporters 41, 42 which face the opening 40 and extend along the coin-passage to support the outer peripheries of true coins TM, so that the coin-selection part 4 can be provided or formed simply and excellently.

The invention set forth in claim 12 is a coin-sending device wherein one coin-supporter 42 does as shown in FIG. 18 comprise a movable member 400 which switches the states of widths of the removal opening 40 between that being smaller than the diameter of true coins TM and that equal to or larger than the same, correspondingly, for example, to such case that all of coins in the coin-reservoir 1 no matter whether they are true or false ones are to be returned to players.

The invention set forth in claim 13 is a coin-sending device wherein the movable member 400 is, as shown in FIGS. 7, 12 and 18, provided at a swing member 403 which swings around a fulcrum 402 by a drive means 401, thereby enabling the coin-supporter 42 comprising the movable member 400 to be provided or structured simply and excellently. The swing member 403 and the movable member 400 (i.e., one coin-supporter 42 between the coin-supporters 41, 42) may be formed integrally other than separately to each other.

The invention set forth in claim 5 is a coin-sending device wherein a coin-scoop means 43 is formed at a junction between a remote end of the removal opening 40 and the second-side passage 2 as shown in FIGS. 13 to 15, whereby true coins discriminated at the coin-selection part 4 are smoothly transferred to and received by the second-side passage 2.

The invention set forth in claim 6 is a coin-sending device wherein a coin sensor 6 is provided for detecting coins on the second-side passage 2 before introduced into the coin-selection part 4 as shown in FIG. 4, in order to dispose, for example, such case that idling of the rotary disc 3 is to be detected.

The invention set forth in claim 7 is a coin-sending device wherein an overflow guide 10 is provided, as shown in FIG. 3, at the first-side reservoir 1 for causing coins excessively stored therein to overflow in a predetermined direction, so that coins when exceed the capacity of the first-side reservoir 1 can be disposed well.

The invention set forth in claim 8 is a coin-sending device wherein the whole device is, as shown in FIG. 3, slanted with respect to the horizontal plane HP with an outlet 202 of the second-side passage 2 facing downwards, so that true coins can be smoothly taken out of the second-side passage 2. An angle a of slant of the device may be over 45°, preferably 45° or less, for example, about 25°.

The invention set forth in claim 9 is a coin-sending device the whole of which is, as shown in FIG. 1, so incorporated in a game machine 8, which is typically the pachinko-type of slot machine and has a lump-insertion tray 71, a coin-payout device 72 and a coin-payout opening 73, that an inlet of the first-side reservoir 1 communicates the tray 71, an outlet of the second-side passage 2 does so the payout device 72 and the removal opening at the coin-selection part 4 does so the coin-payout opening 73, whereby coin-insertion into the game machine can be readily and excellently carried out.

The invention set forth in claim 10 is a coin-sending device wherein the states of storing of coins in the first-side reservoir 1 in the coin-sending device incorporated in the game machine 8 can be seen from the outside as shown in FIGS. 1 and 2, so that the number of coins stocked in the reservoir 1 can be approximately grasped from the outside.

The invention set forth in claim 14 is a coin-sending device wherein there is provided a coin sensor 9 for detecting coins inserted into the lump-insertion tray 71 as shown in FIG. 1 and there is included a control means for starting rotation of the rotary disc 3 correspondingly to output of the sensor 9 as shown in the steps S6 and S10 in FIG. 21, so that when coins are placed onto the lump-insertion tray 71, a coin-sucking operation is automatically carried out.

The invention set forth in claim 15 is a coin-sending device wherein there is included a control means for stopping the rotary disc 3 in rotation as shown in the steps S8 and S14 in FIG. 21 correspondingly to operation of coin-insertion switches 81, 82 or 83 operated for each play as shown in FIG. 2, so that when a player starts the game in the midst of the automatic coin-sucking operation, the automatic coin-sucking is ended to allow the player to concentrate on the game, and the state of credit of coins is made apparent.

The invention set forth in claim 16 is a coin-sending device wherein there is provided a coin sensor 6 for detecting coins sent from the rotary disc 3 as shown in FIG. 4 and there is included a control means which stops the rotary disc 3 in rotation, as shown in the steps S9 and S13 in FIG. 21, when non-detecting state of the coin sensor 6 during rotation of the rotary disc 3 continues over a predetermined time interval, whereby the automatic coin-sucking can be automatically ended correspondingly to no coins remaining in the reservoir. The coin sensor 6 may use two sensors each separately detecting true or false coins after discriminated and diverged, other than the sensor provided before the coin-selection part 4 as defined in claim 9.

The invention set forth in claim 17 is a coin-sending device wherein there is provided a manual-storing switch 70 as shown in FIG. 2 and there is included a control means for starting the rotary disc 3 according to a turn-on operation of the switch 70 as shown in the steps S15 and S19 in FIG. 22 and stopping the rotary disc 3 according to a turn-off of the switch 70 as shown in the steps S17 and S22 in FIG. 22, so that coins stored in the first-side reservoir 1 is subject to sucking operation freely within a player's discretion.

The invention set forth in claim 18 is a coin-sending device wherein there is included a control means for stopping the rotary disc 3 in rotation, as shown in the steps S18 and S23 in FIG. 22, according to activation of a game-start switch 80 operated in each play as shown in FIG. 2, whereby when the game is started during the manually-operated sucking operation, the sucking operation is ended to allow the player to concentrate on the game and the correlation between the state of credit of coins and the results of the game such as wins, etc., is made apparent.

The invention set forth in claim 19 or 20 is a coin-sending device wherein there is included a control means for stopping the rotary disc 3 in rotation when the number of true coins taken out of the outlet of the second-side passage 2 to be credited reaches a predetermined number as shown in the steps S7 and S13 in FIG. 21 and in the steps S16 and S23 in FIG. 22, so that the number of coins to be preliminarily credited in the machine for a plenty of plays is kept from being too large, thereby enabling playing the game to be wholesome. The predetermined number of coins entered in credit may be about fifty.

The invention set forth in claim 11 is a coin-sending device wherein the coin-selection part 4 is provided with a forcible-discharge mechanism (see FIG. 19) which causes all of coins to be discharged into the removal opening according to activation of a settlement switch 84 (see FIG. 2), as shown in the steps S1 and S3 in FIG. 21, correspondingly, for example, to such case that the game is to be stopped freely in players' discretion even when coins inserted are still remaining in the first-side reservoir 1. The forcible-discharge mechanism may have the structures disclosed, for example, in claims 4 to 13.

Next, functional effects of those inventions will be detailed.

In the invention set forth in claim 1, the coin-selection part 4 is formed, as shown in FIGS. 11 and 12, in the forcible-transfer passage 20 in which the transfer force of the rotary disc 3 acts on coins sent, and false coins IM are removed from the passage as clarified in FIG. 17 according to driving of the rotary disc 3 to thereby allow only true coins TM to be taken out as shown in FIG. 13. Accordingly, discriminating coins as well as lining up coins can be performed at the same point where the rotary disc 3 is provided. Difference in height between the inlet of the lump-insertion of coins and the outlet of coins after discriminated can be made smaller. Hence, restriction in spaces inside various machines for mounting the coin-sending device can be mitigated, and enlargement and complexity of the structures of the machines can be prevented.

In the invention set forth in claim 2, as shown in FIG. 16, the true-coin sensor 5 does not detect false coins that have been removed by the coin-selection part 4 but detects only true coins TM. Thus, counting true or standardized coins and recognition of their passing can be precisely carried out without errors.

In the invention set forth in claim 1, as shown in FIGS. 11 and 12, coins M are smoothly travelled by the coin-transfer means 30 along the second-side passage 2 including the arcuate passage 200 following rotation of the rotary disc 3 and are smoothly guided to the coin-selection part 4, thereby enabling the coin-selection to be excellently performed.

In the invention set forth in claim 3, as seen in FIG. 6, the second-side passage 2 includes a recess 201 having a necessary depth for coin M in the direction of its thickness, and enabling the whole device to be made flat or smaller in height. And the passage is built by layering the cover member on the base member, thereby making simple the structure.

In the invention set forth in claim 4, as shown in FIG. 13, true coins TM which are each supported at both lateral sides by a pair of coin supporters 41, 42 at the coin-selection part 4 are transfered to and received by the second-side passage 2. As seen in FIG. 17, false coins IM smaller in diameter than true coins are not supported by the supporters 41, 42 to be removed through the removal opening 40. Thus, coin-selection can be performed simply and excellently.

In the invention set forth in claim 12, one coin-supporter 42 allows the width of opening of the removal opening 40 to be equal to or larger than diameter of true coins TM as shown in FIG. 19. Hence, true coins TM can be also retreived through the removal opening 40.

In the invention set forth in claim 13, as seen in FIG. 7, the swing member 403 swings around the fulcrum 402 by the drive means 401 to shift the coin-supporter 42 comprising the movable member 400. And the usual selection state shown in FIGS. 12 and 13 and the state of retrieval of all coins shown in FIGS. 18 and 19 can be readily realized.

In the invention set forth in claim 5, as seen in FIG. 13, true coins TM which slant downwards when about to be received by the second-side passage 2 after passing the coin-selection part 4 can be corrected in posture by the coin-scoop means 43. Hence, true coins can be smoothly guided and transferred to the second-side passage 2 without striking the end part of the removal opening 40.

In the invention set forth in claim 6, as seen in FIG. 4, all coins before introduced into the coin-selection part 4 can be detected by the coin sensor 6. Thus, when the state having no such detection continues, there can be known or recognized the facts that no coins are sent from the rotary disc 3 and the rotary disc 3 is idling. Furthermore, all of coins no matter whether they are true or false ones can be counted up at the same place.

In the invention set forth in claim 7, as shown in FIG. 3, excess of stored coins overflows in a predetermined direction along the overflow guide 10. Hence, the excess of coins over the capacity of the reservoir can be disposed well.

In the invention set forth in claim 8, as seen in FIG. 3, the whole device is set slantwise with respect to the horizontal plane HP with the outlet 202 of the second-side passage 2 facing downwards, so that true coins can be taken out excellently.

In the invention set forth in claim 9, as seen in FIG. 1, coins inserted in a lump from the lump-insertion tray 71 are first stocked in the first-side reservoir 1 and then sequentially discriminated one by one, so that true coins are fed from the outlet 202 of the second-side passage 2 to the coin payout device 72. False coins removed by the coin-selection part 4 go to the coin payout opening 73. Accordingly, coins can be lined up and discriminated at the same place or point, whereby the height of the outlet for true coins after discriminated can be set to be sufficiently or substantially high in comparison with the coin-payout device 72, so that the lump-insertion tray 71 can be disposed in a proper position without being intentionally higher in comparison with the conventional one-by-one insertion type of coin slot. Hence, players can easily insert coins in a lump at a proper or favourable position. And coins can be prevented from jamming in the coin passage in the game machine.

In the invention set forth in claim 10, as shown in FIGS. 1 and 2, coins inserted into the machine 8 and stocked in the first-side reservoir 1 can be seen from the outside to be readily watched or observed of their being stored or not, or of stored in a large or small number.

In the invention set forth in claim 14, as shown in FIG. 1, coins when placed into the lump-insertion tray 71 are detected by the coin sensor 9. According to the detection by the coin sensor 9, the rotary disc 3 is rotated automatically as seen in the steps S6 and S10 in FIG. 21, so that coins are taken in automatically and lined up and discriminated.

In the invention set forth in claim 15, when any of coin-insertion switches 81, 82 and 83 is operated, as shown in FIG. 2, during the automatic coin-sucking operation, the rotary disc 3 in rotation is stopped as seen in the steps S8 and S14 in FIG. 21. Hence, players can concentrate on the game, and there is prevented an entangled change in the numerical indication caused by or between deduction from the credit corresponding to the number of coins to be used for the game about to be played and addition to the credit corresponding to the automatic coin-sucking operation.

In the invention set forth in claim 16, when there is no coins to be sent by the rotary disc 3, the coin-sensor 6 is brought into the non-detecting state over a predetermined time interval to thereby cause the rotary disc 3 to be automatically stopped as shown in the steps S9 and S13 in FIG. 21. Hence, the automatic sucking operation is properly ended, thereby enabling energy saving and less noise generation.

In the invention set forth in claim 17, when the manual-storing switch 70 is turned on as shown in FIG. 2, the rotary disc 3 rotates as shown in the steps S15 and S19 in FIG. 22 to enable the manually-activated coin-sucking operation. When the switch 70 is turned off, the rotary disc 3 is stopped as shown in the steps S17 and S22 in FIG. 22 to end the manually-activated coin-sucking. Accordingly, players can arrange and use the coin-storage in their discretion for playing the game.

In the invention set forth in claim 18, when the game start switch 80 is operated during the manually-activated coin-sucking operation as shown in FIG. 2, the rotary disc 3 in rotation is stopped as seen in the steps S18 and S23 in FIG. 22. Hence, players can concentrate on the game and clearly comprehend coins obtained by winning the game.

In the invention set forth in claim 19 or 20, as seen in the steps S7 and S13 in FIG. 21 and the steps S16 and S23 in FIG. 22, when the number of coins credited in the game machine 8 becomes a predetermined number, the rotary disc 3 is stopped to end the coin-sucking operation. Thus, it can be prevented that coins in a quite large number are taken into the machine 8 at a time, thereby enabling playing the game to be wholesome.

In the invention set forth in claim 11, as seen in the steps S1 and S3 in FIG. 21, when the settlement switch 84 is operated, all of stored coins are forcibly discharged to the coin-payout opening 73 through the removal opening at the coin-selection part 4. Thus, players can stop the game freely in their discretion without having loss of coins.

Preferred Embodiments of the Invention

Figure 1:
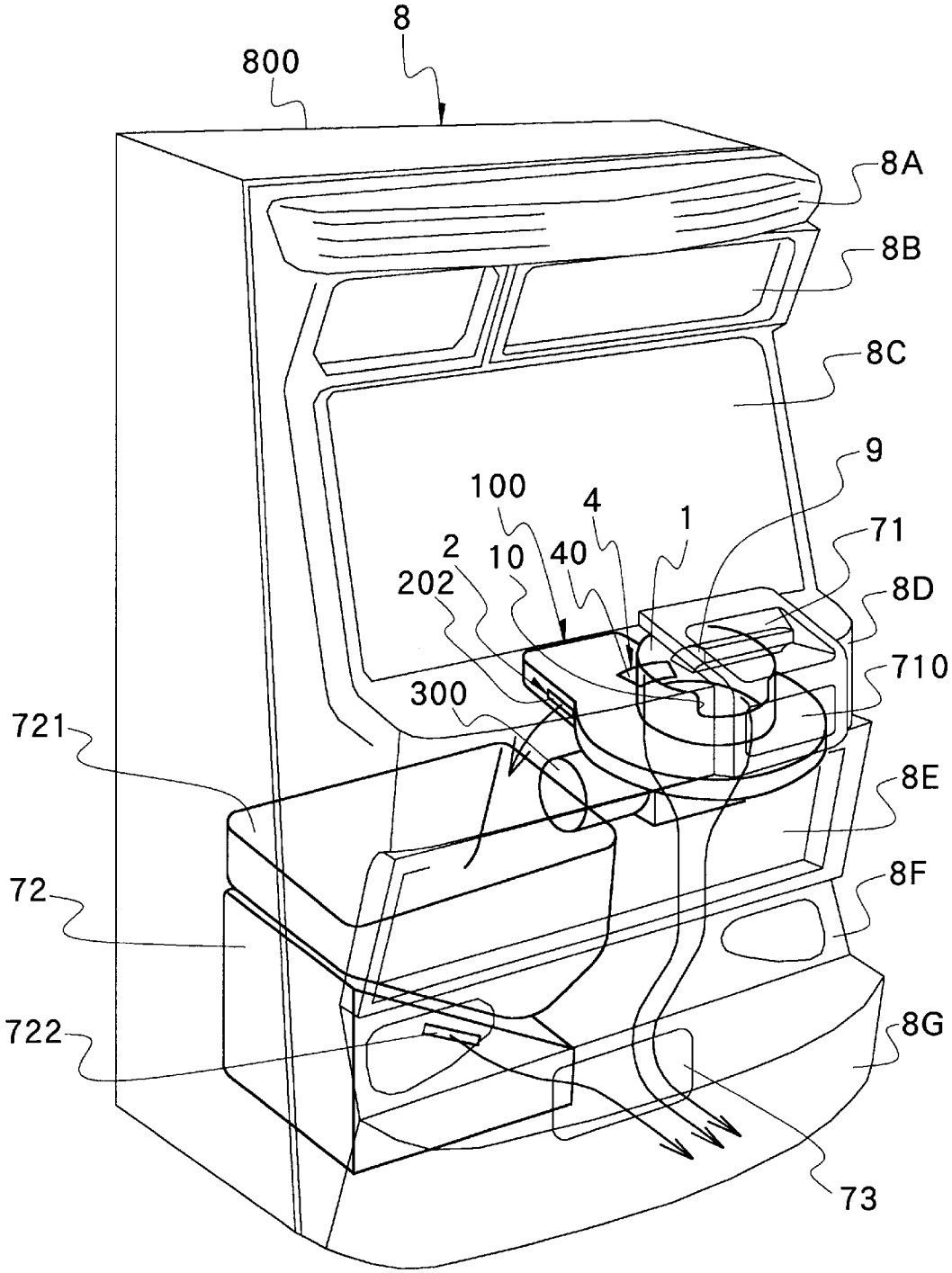
FIG. 1 is a schematic perspective view showing a game machine incorporating the coin-sending device according to the present invention.

FIG. 1 shows a game machine 8 which is the pachinko type of slot machine incorporating a coin-sending device 100 according to the present invention. The pachinko type of slot machine is a slot machine having the same height and width as those of a frame of the pachinko machine. Coins referred to herein employ metal discs (called "game medals"), for example, of 24.6 to 25.5 mm in diameter and of 1.4 to 1.8 mm in thickness. A casing 800 of the machine is provided at the front side with an indicator 8A showing the states of playing the game, an allotment panel 8B, a reel-part panel 8C, a switches-mounting part 8D, a waist panel 8E, a front-speaker panel 8F and a coin-tray 8G.

The switches-mounting part 8D has a lump-insertion tray 71 for inserting coins in a lump, the casing 800 houses at its lower part a coin-payout device 72 having a coin bucket 721 and a coin-discharge part 722, and the coin tray 8G has a coin-payout opening 73 at the inner side. An inlet of a first-side reservoir 1 in the coin-sending device 100 is connected to the tray 71, an outlet 202 of a second-side passage 2 to the coin bucket 721 and a removal opening at a coin-selection part 4 to the coin-payout opening 73. A coin-sensor 9 for detecting coins inserted is provided inwardly of the lump-insertion tray 71. The arrows in FIG. 1 show the flow of coins.

Figure 2:
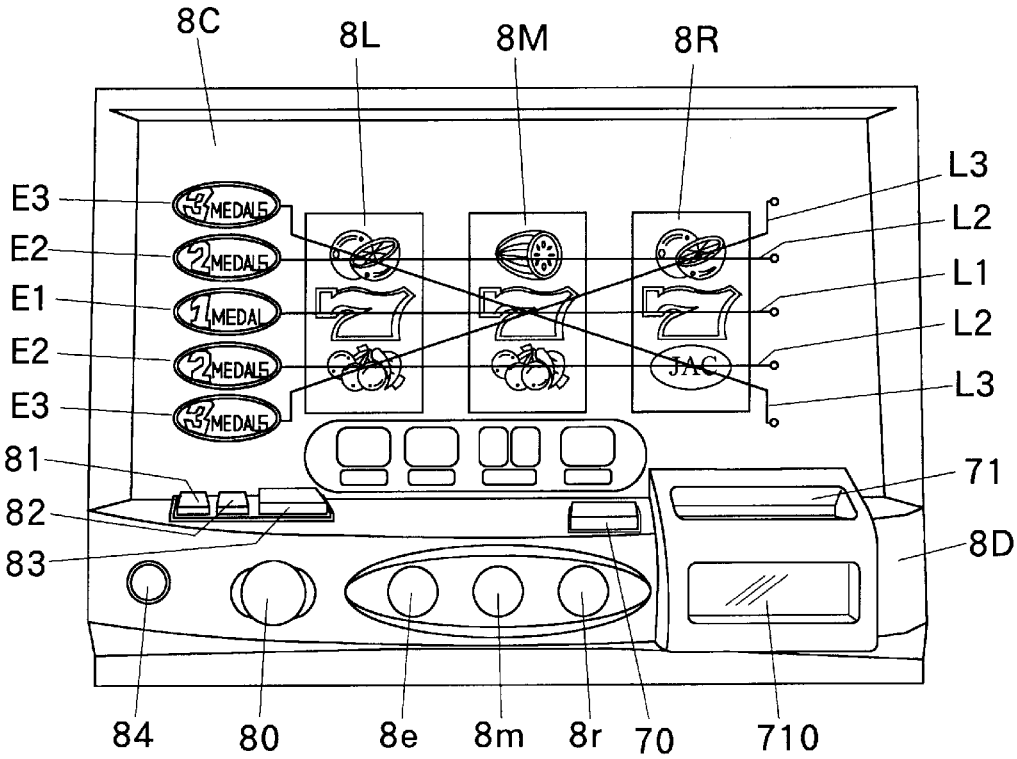
FIG. 2 is a front view of a principal part of the game machine.

As seen in FIG. 2, three mechanical reels 8L, 8M and 8R on the outer peripheries of which figures, such as "7", "cherries" and "oranges", are expressed are housed inside the reel-part panel 8C. When the reels are stopped, three figures are seen on each reel. The number of the figures expressed on each reel is about twenty one (21).

Provided on the switches-mounting part 8D are coin-insertion switches (or coin-use switches) including a 1-bet switch 81 for the case using a single coin for a play, a 2-bet switch 82 for that using two coins and a max-bet switch 83 for that using three coins (at maximum). According to the number of coins used or inserted, judgement lines become valid, namely, a single coin when used or inserted causes the central judgement line L1 to become valid, two coins do so three judgement lines, i.e., the upper and lower lines L2 as well as the central one L1, and three coins do so five judgement lines including the slant lines L3. Indication lamps E1 to E3 are lit corresponding to specific judgement lines when become valid.

The game is started by moving up or down a game start switch 80 comprising a lever with a coin or coins having been bet by means of the bet-switches, whereby the three reels 8L, 8M, 8R start simultaneously. The reels can be separately stopped by pushing stop buttons 8*e*, 8*m* and 8*r* corresponding to the respective reels, and winnings (and losing) and the number of coins to be alloted corresponding to winnings are determined according to a combination or combination(s) of the foregoing figures aligned on the valid judgement line(s). In case that the stop buttons are not operated, the reels are forcibly stopped about 40 seconds later from the start of the game.

In FIG. 2, the reference numeral 84 designates a settlement switch for switching between a credit state, in which coins are credited to players or preliminarily memorized, with a predetermined upper limit of 50 coins, for a play or plays about to be started or occurring afterwards, and a settlement state in which the credit and coins remaining in the first-side reservoir 1 are paid out. The reference numeral 70 designates a manual storing switch for allowing the coin-sending device 100 to be activated manually to cause coins to be sucked and credited in the machine. The reference numeral 710 designates a transparent plate through which coins stored in the first-side reservoir 1 can be seen from the outside.

Figure 3:
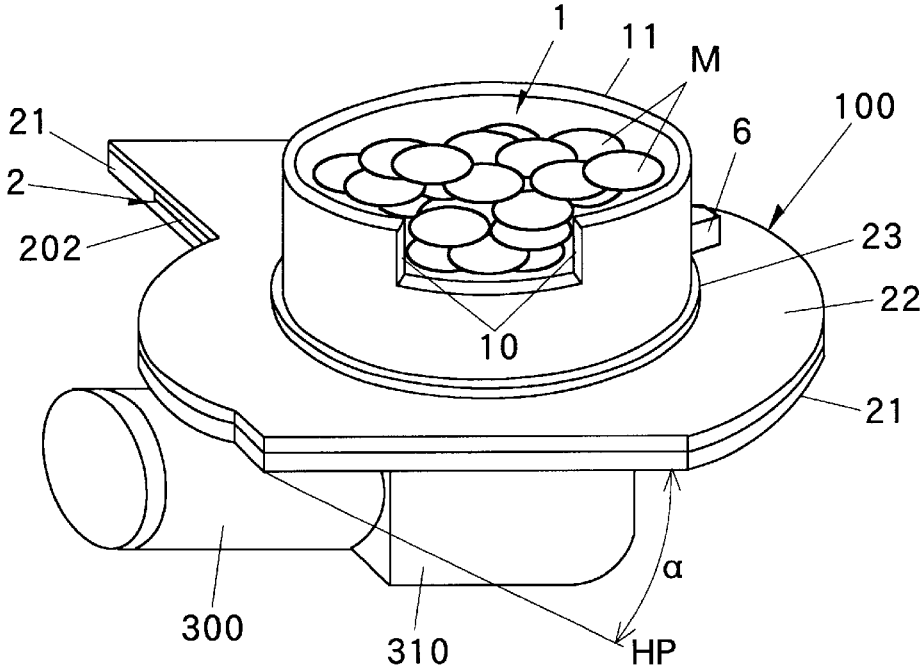
FIG. 3 is a perspective view of the coin-sending device according to the present invention.

As seen in FIG. 3, the coin-sending device 100 is provided with the first-side reservoir 1 including a cylindrical member 11, a base member 21 and a cover member 22 layered thereon between which a second-side passage 2 is defined and a rotary disc 3 is accomodated, and a drive motor 300 and a reduction gear mechanism 310 for the rotary disc 3. The cylindrical member 11 is fixed on the upper part of the cover member 22 by means of a connecting flange 23. The cylindrical member 11 has an overflow guide 10 which is a cut extended in a predetermined range of angle at the upper part of the cylindrical member 11 for causing an excess of stored coins M over a storing limit about 100 to overflow in a predetermined direction to the coin-payout opening 73. The coin-sending device 100 is incorporated in the game machine 8 practically in such manner that with an outlet 202 of the second-side passage 2 facing downwards, the whole device is slanted at an angle $\alpha$ (25°) with respect to the horizontal plane HP.

Figure 4:
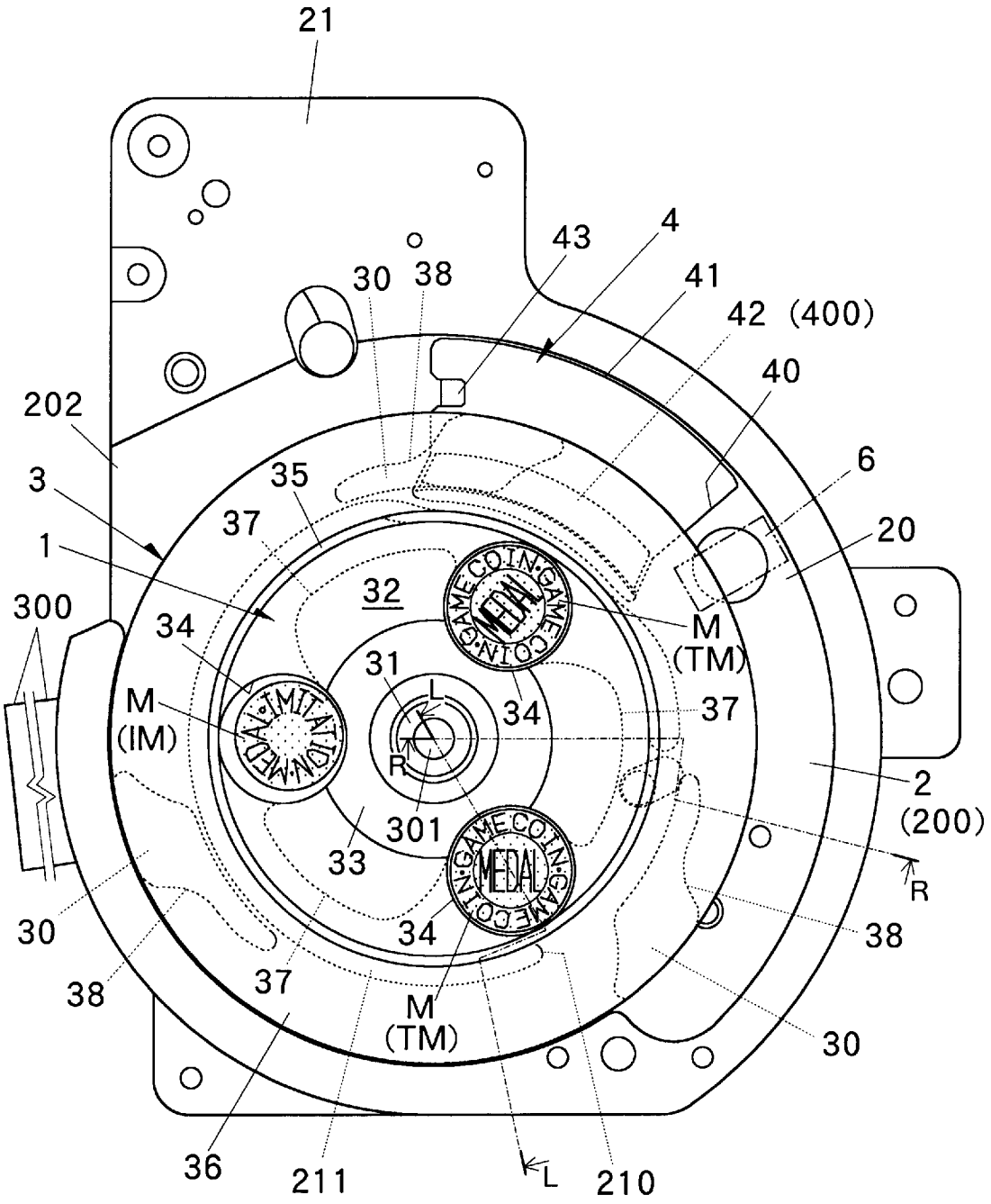
FIG. 4 is a plan view of the coin-sending device with the cover member being removed.

As seen in FIG. 4, the rotary disc 3 includes a boss 31 connected to an output shaft 301 in association with the motor 300, a disc body 32, a coin guide means 33 in a truncated conical shape swelling upwards centrally of the disc body 32, three coin-holes 34 around the coin guide means 33, a tubular guide 35 projecting toward the first-side reservoir 1, an annular flange 36 which is almost flat and extends on the outer periphery of the disc 3, three coin-sending means 37 which project on the rear surface of the disc 3 and are disposed between adjacent holes 34, and three coin-transfer means 30 which project on the same rear surface and are apart from the coin-sending means 37 at a predetermined phase difference. The rotary disc 3 is entirely formed by integral molding using syntheic resin such as polyacetal. The number of rotation of the rotary disc 3 is about 70 rpm.

Figure 5:
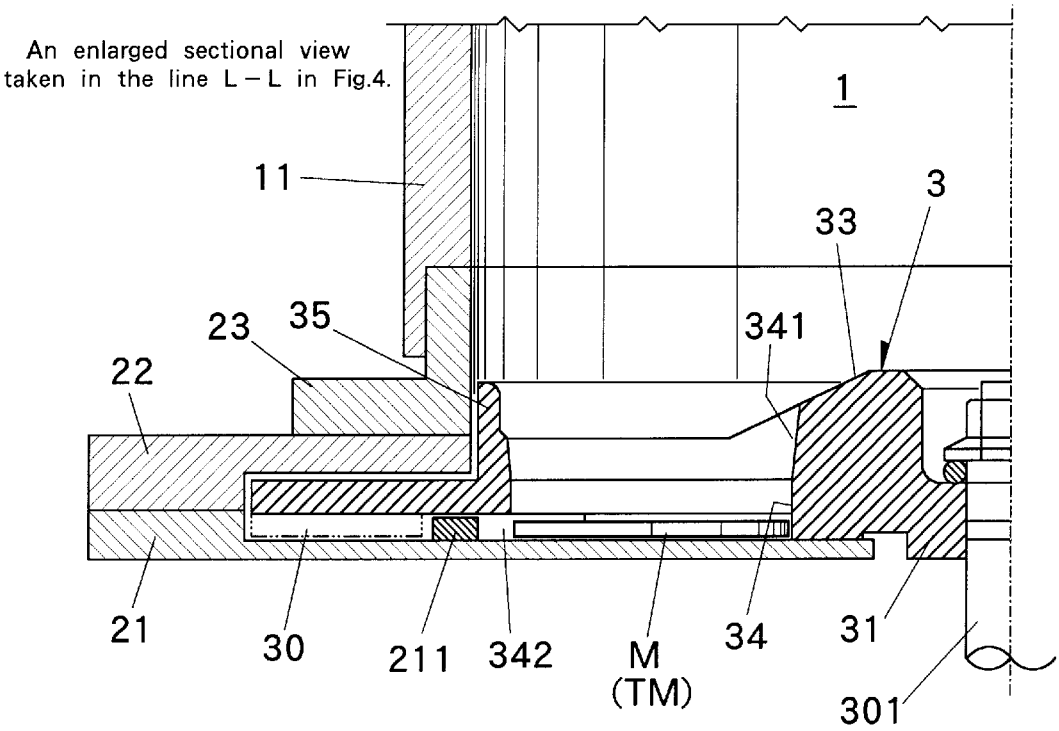
FIG. 5 is an enlarged sectional view taken in the line L—L in FIG. 4.

As seen in FIG. 5, any coins larger in diameter than the normal true coins TM do not fall through a tapered part 341 formed at the inlet side of the coin-holes 34 to thereby be expelled at the inlet part. Also, any coins larger in thickness than the true coins TM when fall in the hole 34 cannot pass a coin-releasing point 342 near the hole 34 to be removed at the outlet part of the hole 34. In any case, larger non-standardized coins are not sent to the second-side of the rotary disc 3. The coin-holes 34 have the same function as that provided by the feature that the opening slit of the conventional one-by-one insertion is set in size according to standardized coins.

Figure 6:
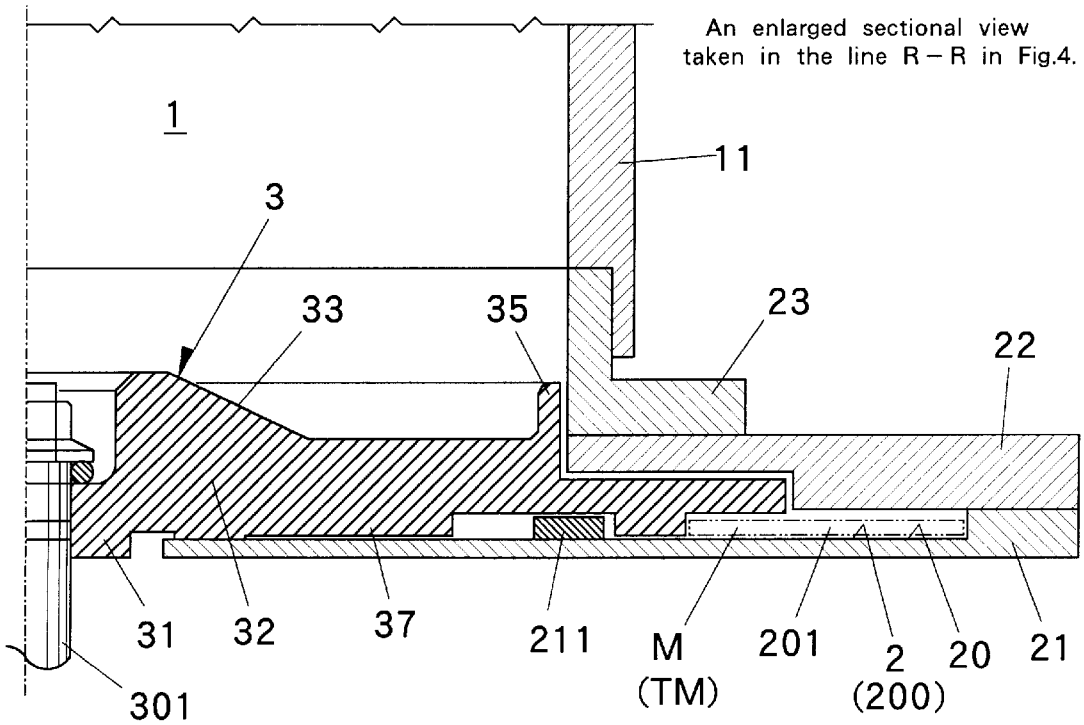
FIG. 6 is an enlarged sectional view taken in the line R—R in FIG. 4.

As seen in FIG. 4, the base member 21 is provided thereon with the second-side passage 2 having an arcuate passage 200 extending along the outer periphery of the rotary disc 3. A coin M sent from the rotary disc 3 is received by the coin transfer means 30 at its front part 38 (which is narrowed or concaved) to be guided and transferred on the second-side passage 2. A forcible-transfer passage 20 in which the transfer means 30 exerts a transfer-force on coins occupies almost the entire area of the second-side passage 2. The second-side passage 2 includes, as shown in FIG. 6, a recess 201 which is formed between the base member 21 and the cover member 22 to have a rectangular cross-section having a height enough to receive the thickness of coins.

A coin-selection part 4 is provided as shown in FIG. 4, on the way of the forcible-transfer passage 20 in the second-side passage 2, which discriminates true coins TM and false coins IM smaller in diameter among coins which sent from the rotary disc 3 and not excessively larger in diameter and thickness. The coin-selection part 4 is provided with a coin-removal opening 40 slightly smaller in width than the diameter of true coins TM, a first coin-supporter 41, which includes a narrow coin-supporting part positioned at the outer side of the coin-selection part 4, a second coin-supporter 42, which forms a movable member 400 positioned inwardly, the coin-supporters 41 and 42 facing the coin-removal opening 40, and a coin-scoop means 43 disposed at the end of the coin-removal opening 40.

In FIG. 4, the reference numeral 211 designates a coin guide which extends circumferentially except a coin-sending point 210 from the rotary disc 3 to the second-side passage 2. The reference numeral 6 designates a coin sensor which comprises, for example, a reflection type photo-sensor for detecting coins before being introduced to the coin-selection part 4.

Figure 7:
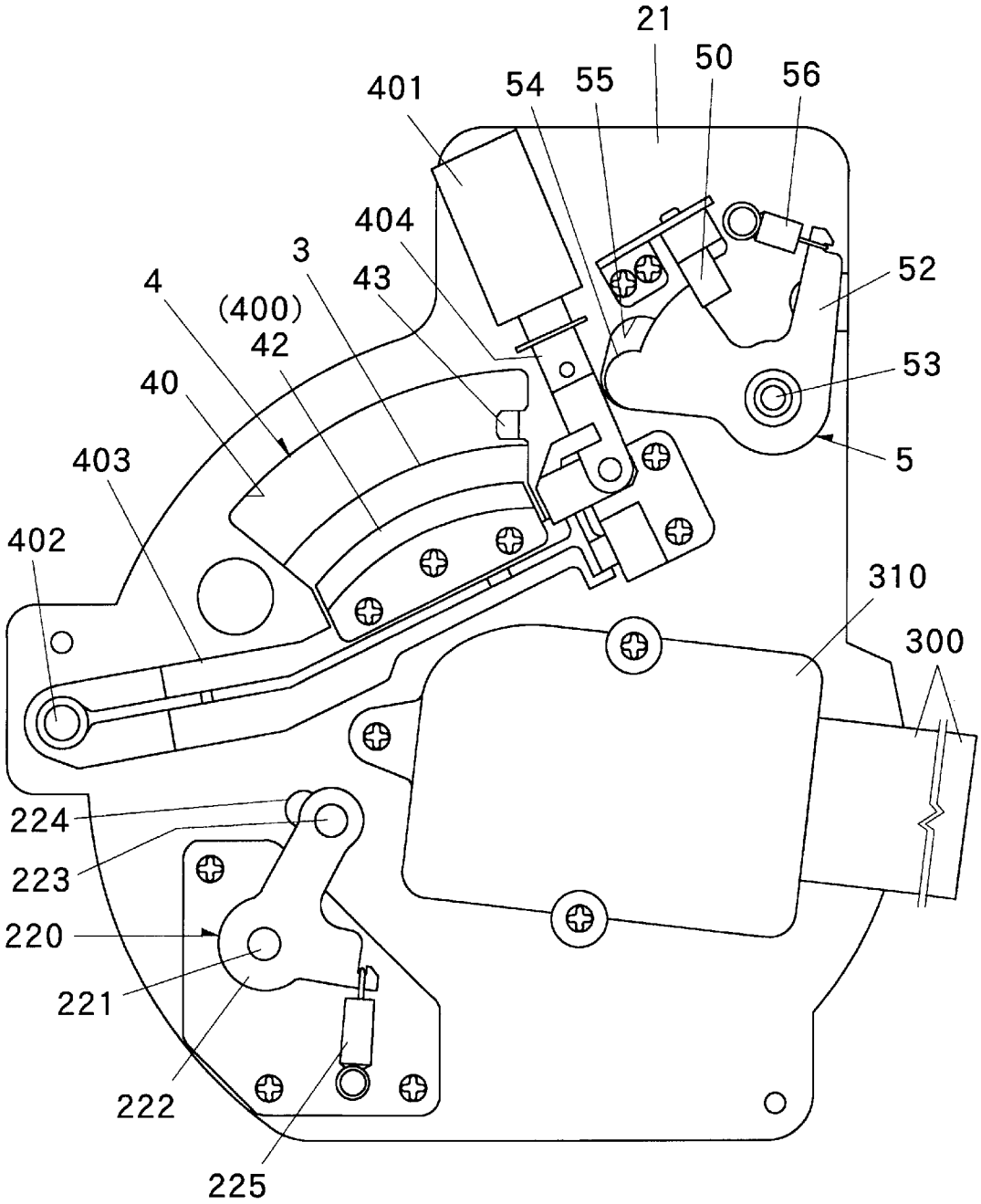
FIG. 7 is a bottom view of the coin-sending device.

As seen in FIG. 7, the second coin supporter 42 provided at the coin-selection part 4 is mounted to a swing member 403, which swings around a fulcrum 402, and can be switched between a usual selection state (FIGS. 4, 11–13, 16 and 17) and an all-coin retreival state (FIGS. 18 and 19) by a solenoid type of drive means 401 having a rod 404 which moves forwards and backwards following electricity turned on and off.

Figure 8:
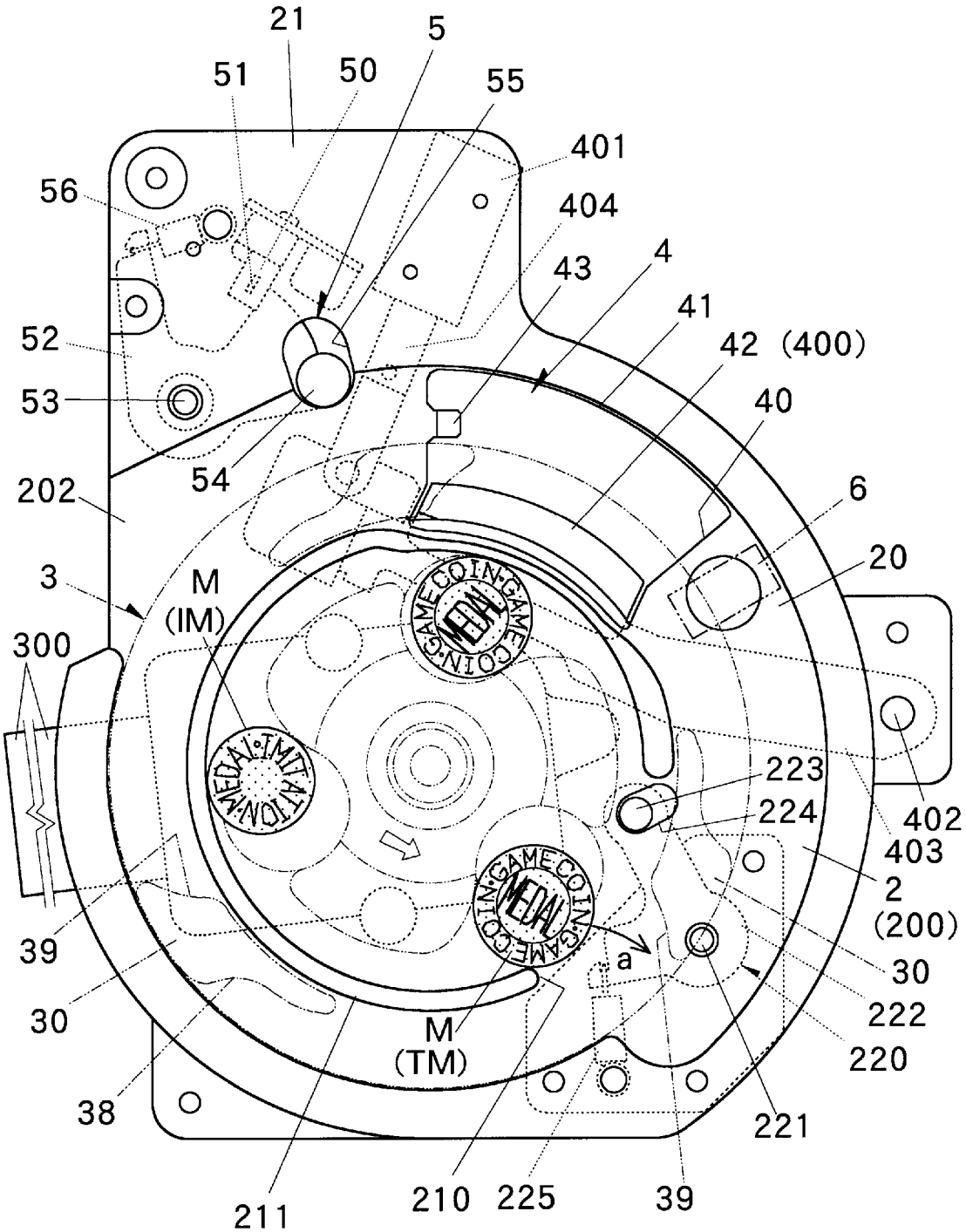
FIG. 8 is an explanatory view showing a first action (or function) of the coin-sending device.

As seen in FIG. 8, when the rotary disc 3 rotates counterclockwise (indicated by the hollow arrow), each coin M which has fallen in the hole 34 to the bottom shifts slightly outwards from the hole to abut against the inner periphery of the coin guide 211 and be transferred by the coin-sending means 37. The coin when reaches the coin-releasing point 210, at which the coin guide 211 terminates, is released in the direction indicated by the solid line a by a centrifugal force to the second-side passage 2. Releasing the coin M is smooth since the plane on which the coin is transferred along the coin guide 211 is level with the plane of the second-side passage 2. The coin-transfer means 30 has at its rear side a narrow concaved part 39 by which the coin M is guided to the second-side passage 2 without being prevented from being sent from the rotary disc 3.

Figure 9:
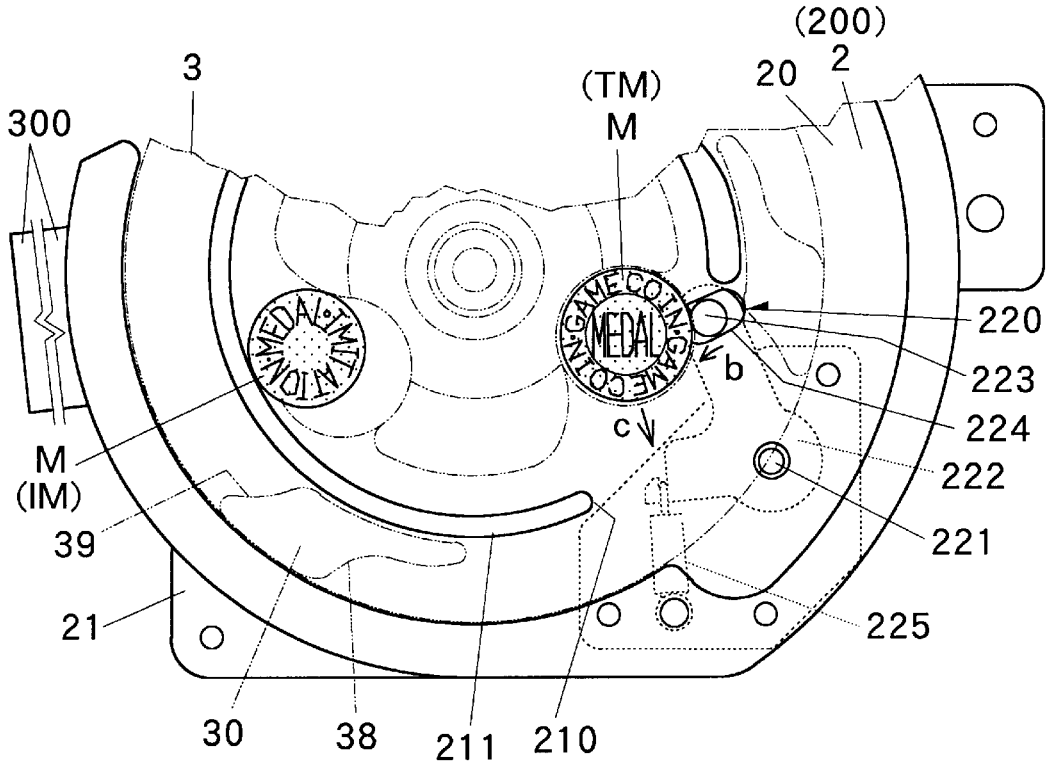
FIG. 9 is an explanatory view showing a second action of the same.

As seen in FIG. 9, a coin M which did not shift from the bottom of the hole 34 outwards to the coin guide 211 and has been carried by the coin-sending means 37 as illustrated can be helped going out by an anti-lock mechanism 220 formed near the end of the coin-sending point 210. In detail, the anti-lock mechanism 220 comprises a fulcrum 221, a linkage member 222 swingable around the fulcrum, a pin 223 projecting on the linkage member, an elongate hole 224 for the pin 223 and a spring 225 for biasing the linkage member. When the coin M carried by the coin-sending means 37 is brought into contact with the pin 223, the pin's counterclockwise restoring force (indicated by the arrow b) causes the coin M to escape from the coin-sending means 37 outwards (indicated by the arrow c). The anti-lock mechanism 220 cannot cause a false coin having non-standardized larger thickness to escape from the hole 34. But locking of the rotary disc 3 can be prevented by moving the pin 223 back a t maximum.

Figure 10:
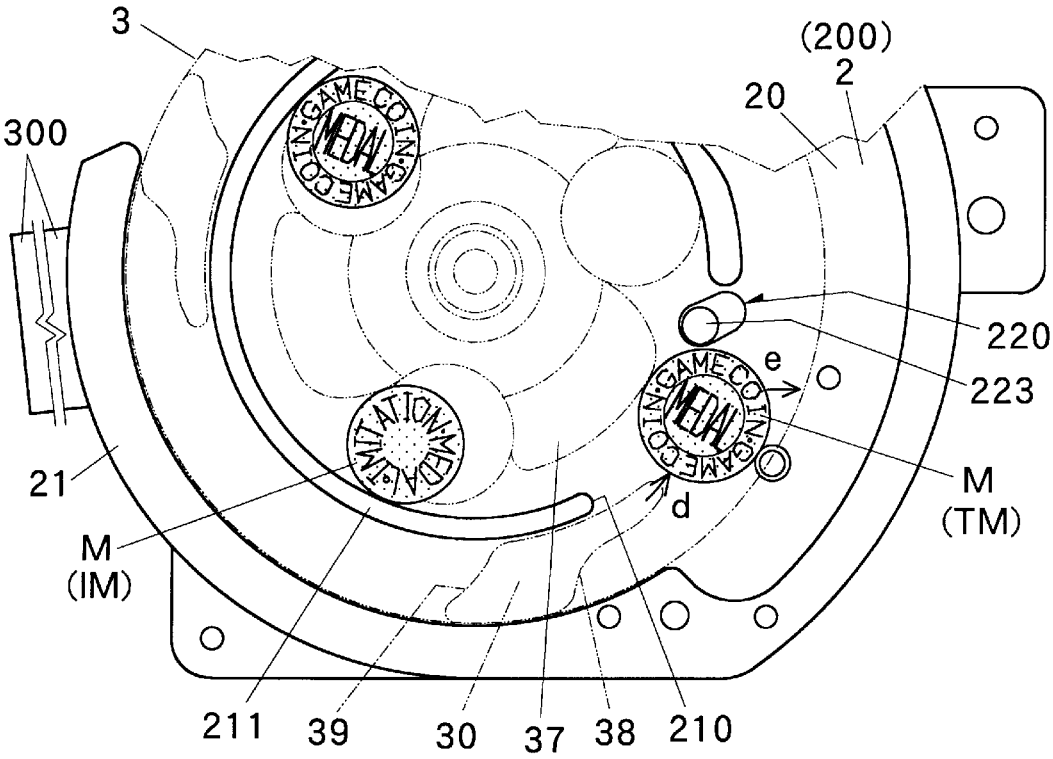
FIG. 10 is an explanatory view showing a third action of the same.

In case that a coin M is not sufficiently away from the coin-releasing point 210 and stops on the way as shown in FIG. 10, one end of the coin-transfer means 30 flicks the coin M circumferentially (indicated by the arrow d), causing the coin M to be sent outwards (indicated by the arrow e) without returning inwardly due to hindering by the coin-sending means 37 and pin 223 of the anti-lock mechanism 220.

Figure 11:
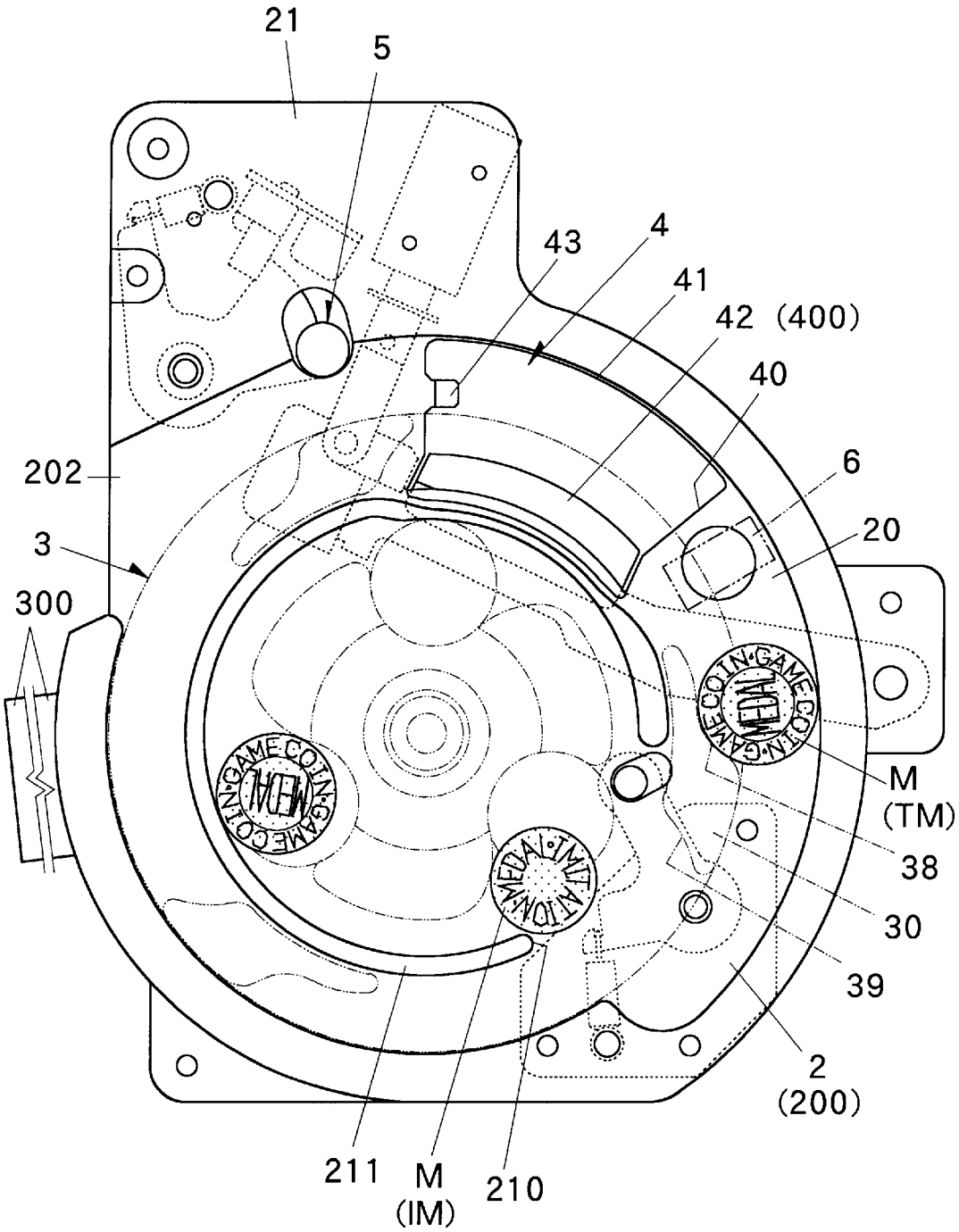
FIG. 11 is an explanatory view showing a fourth action of the same.

FIG. 11 shows the coin M sent to the second-side passage 2 and forcibly transferred by the coin-transfer means 30. The coin M passing the coin sensor 6 is detected by the sensor.

Figure 12:
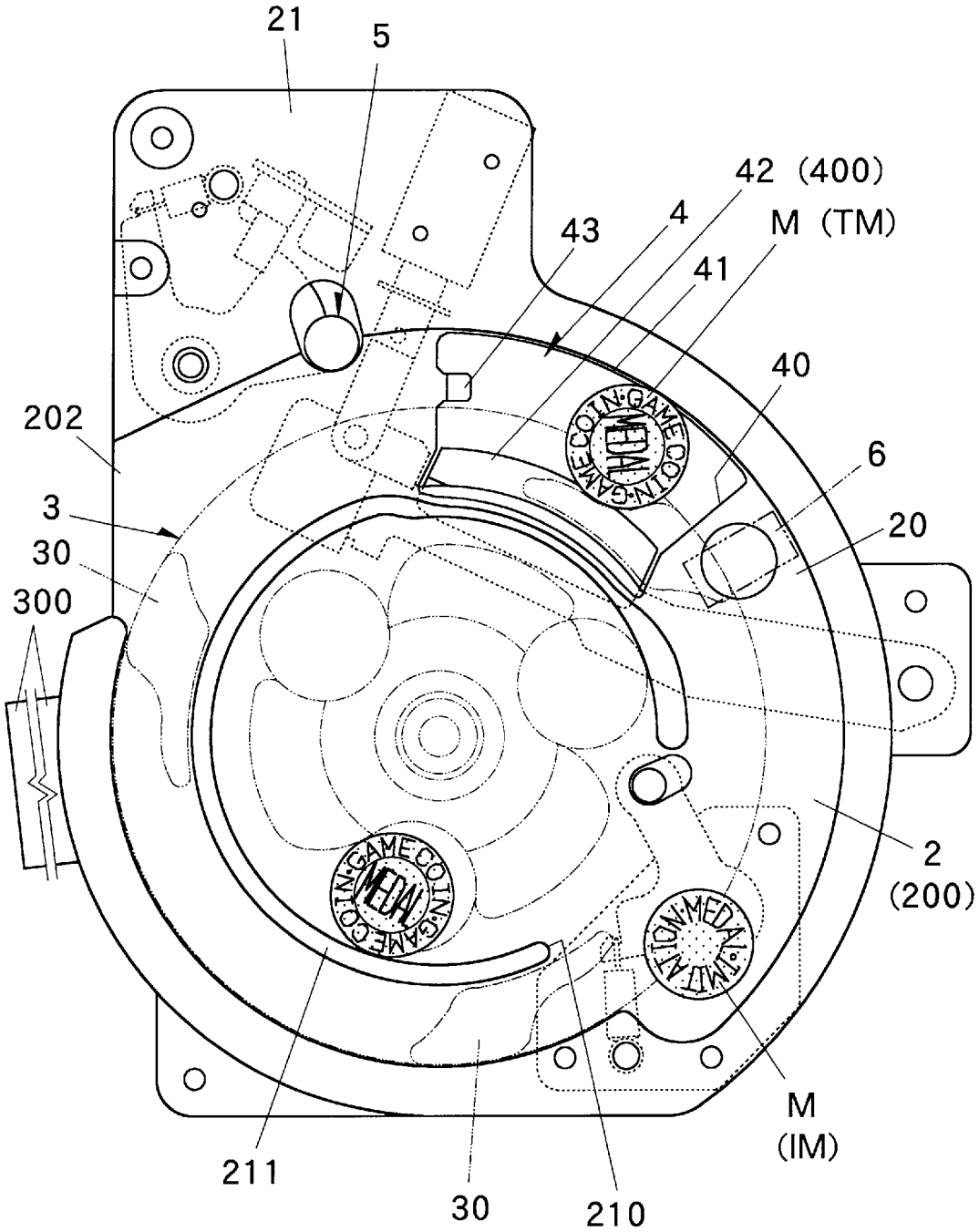
FIG. 12 is an explanatory view showing a fifth action of the same.

Coins M then pass the coin-selectin part 4 as seen in FIG. 12.

Figure 13:
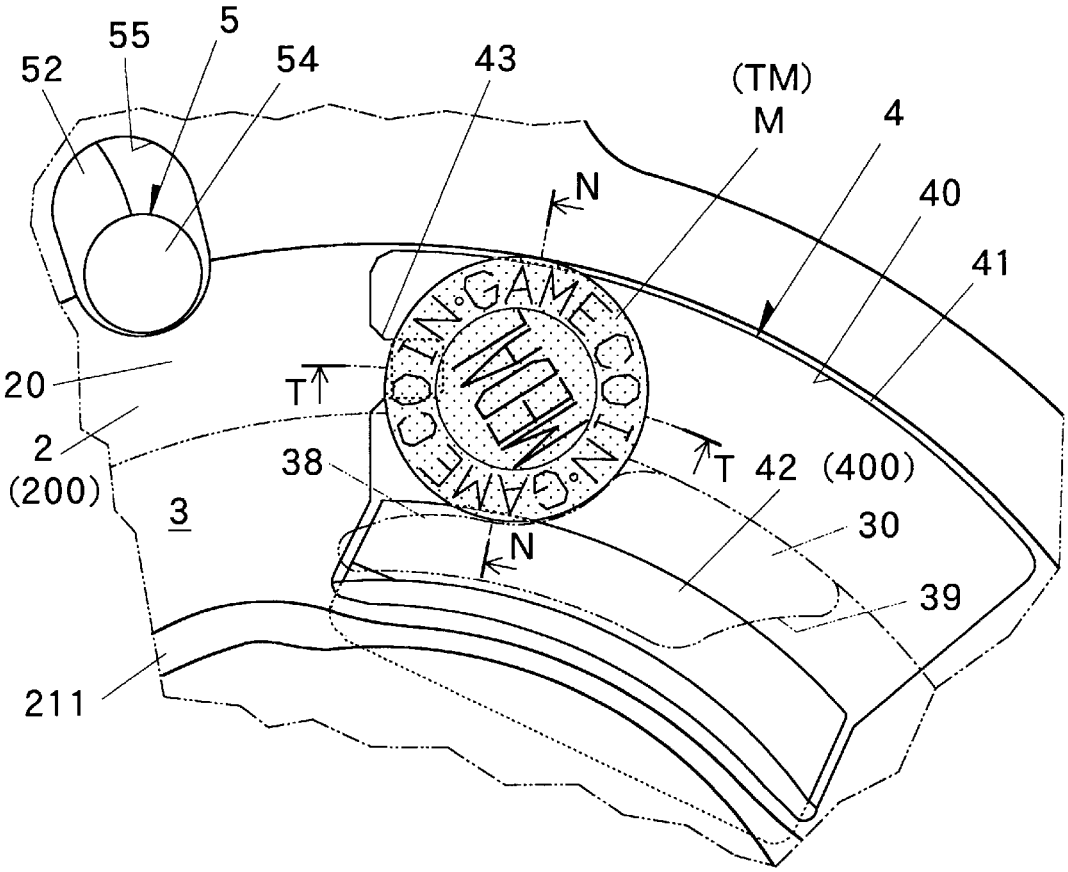
Fig. 13 is an enlarged explanatory view showing a sixth action of the same.
Figure 14:
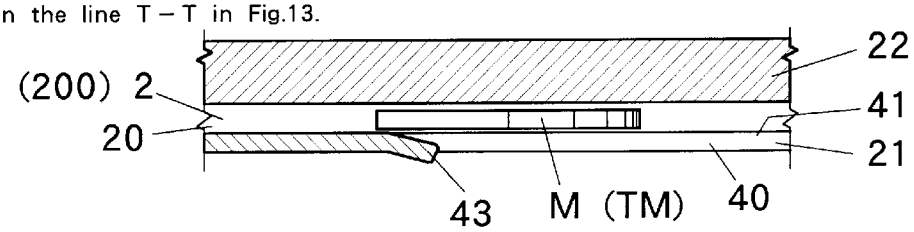
FIG. 14 is a sectional view taken in the line T—T in FIG. 13.
Figure 15:
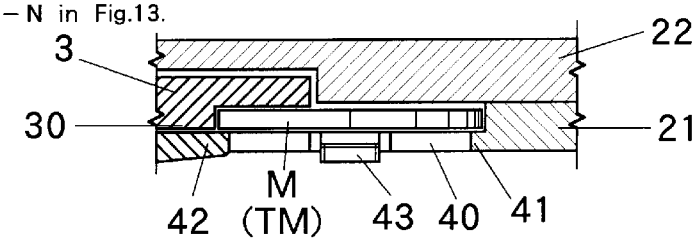
FIG. 15 is a sectional view taken in the line N—N in FIG. 13.

As explained in FIG. 13, true coins TM in a standardized size are supported at both lateral ends opposing in the direction of diameter by the first and second coin supporters 41, 42 to be conveyed without falling in the coin removal opening 40. The upper surfaces of coins face closely a rear surface of the cover member 22, whereby there is no fear that the coins are turned over. True coins when tend to sink down or slant at their front side at the end of the coin-selection part 4 can be supported or received by the coin-scoop means 43 as shown in FIGS. 14 and 15 to be smoothly transferred to the second-side passage 2.

Figure 16:
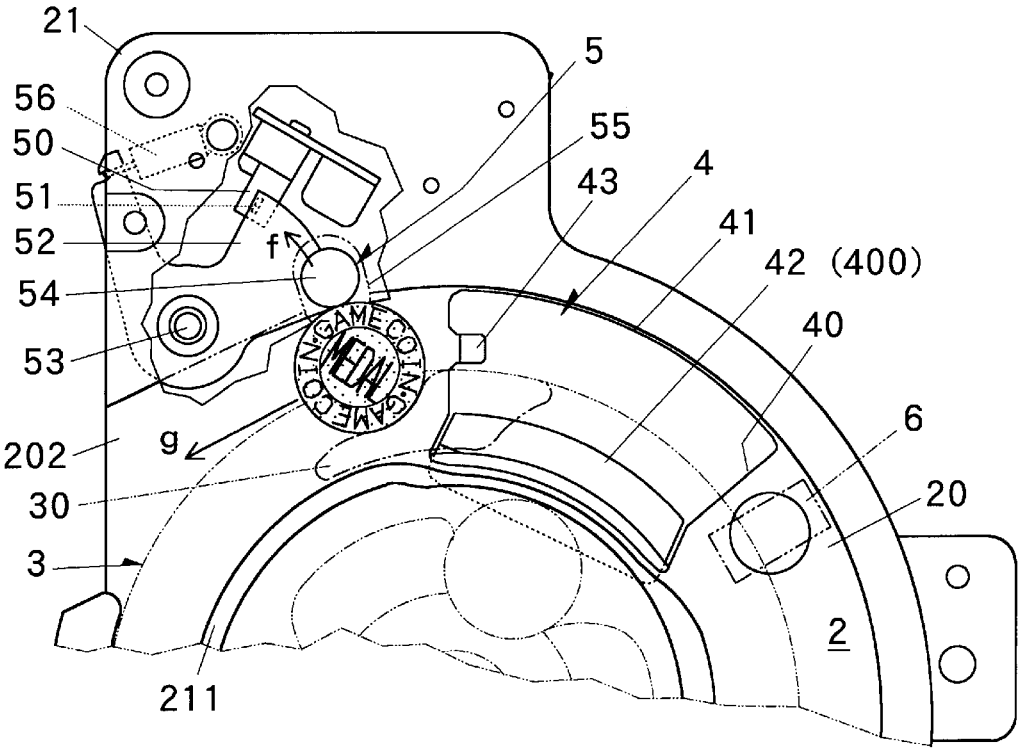
FIG. 16 is an explanatory view showing a seventh action of the coin-sending device.

As shown in FIG. 16, a true-coin sensor 5 is provided downstream of the coin-selection part 4. The sensor 5 comprises a detecting unit 50 using a transmission type photosensor, a linkage member 52 swingable to move in and away from a detection optical path 51, a fulcrum 53 for the linkage member 52, a pin 54, an elongate slot 55 for the pin 54 and a spring 56 for biasing the linkage member. True coins TM after subjected to the discriminating operation are brought into contact with the pin 54 to move the pin 54 backwards counterclockwise (indicated by the arrow f), whereby causing the linkage member 52 to be across the optical path 51 to detect a true coin and add one to the credit accordingly. The true coins TM after passing the sensor 5 are discharged from the outlet 202 of the passage 2, as indicated by the arrow g, to the coin bucket 721 of the coin payout device72.

Figure 17:
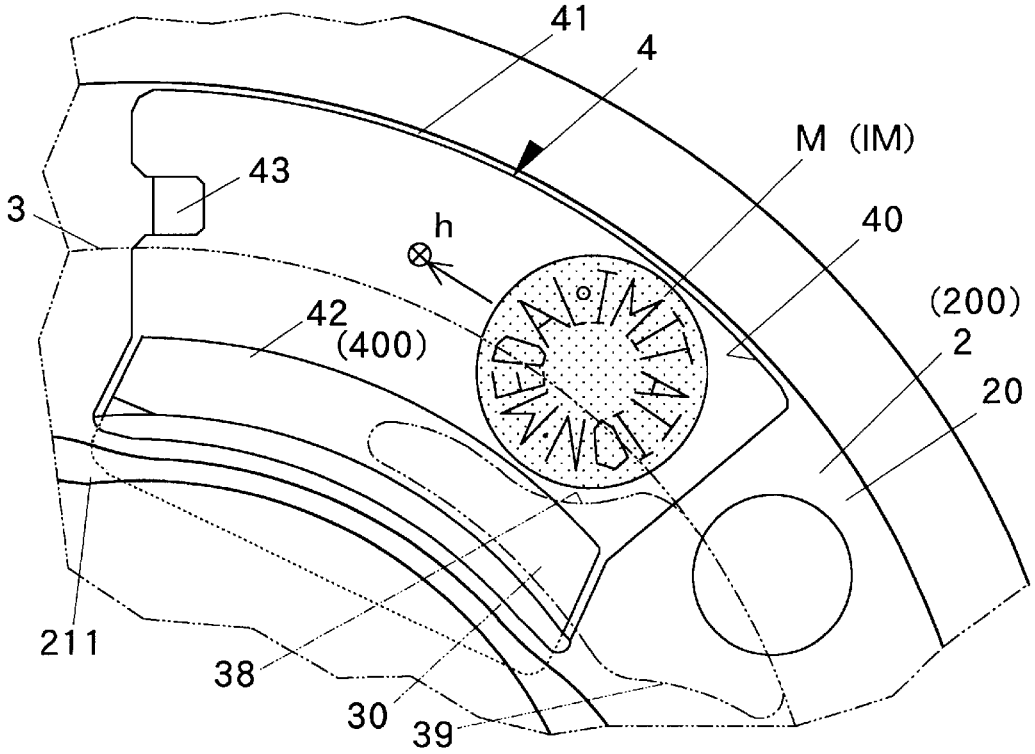
FIG. 17 is an enlarged explanatory view showing an eighth action of the same.

As shown in FIG. 17, when a false coin IM smaller in diameter than true coins is introduced to the coin-selection part 4, the false coin is not supported at both lateral ends by the first and second coin supporters 41 and 42 and falls in the coin-removal opening 40 (indicated by the arrow h) to the coin payout opening 73.

Figure 18:
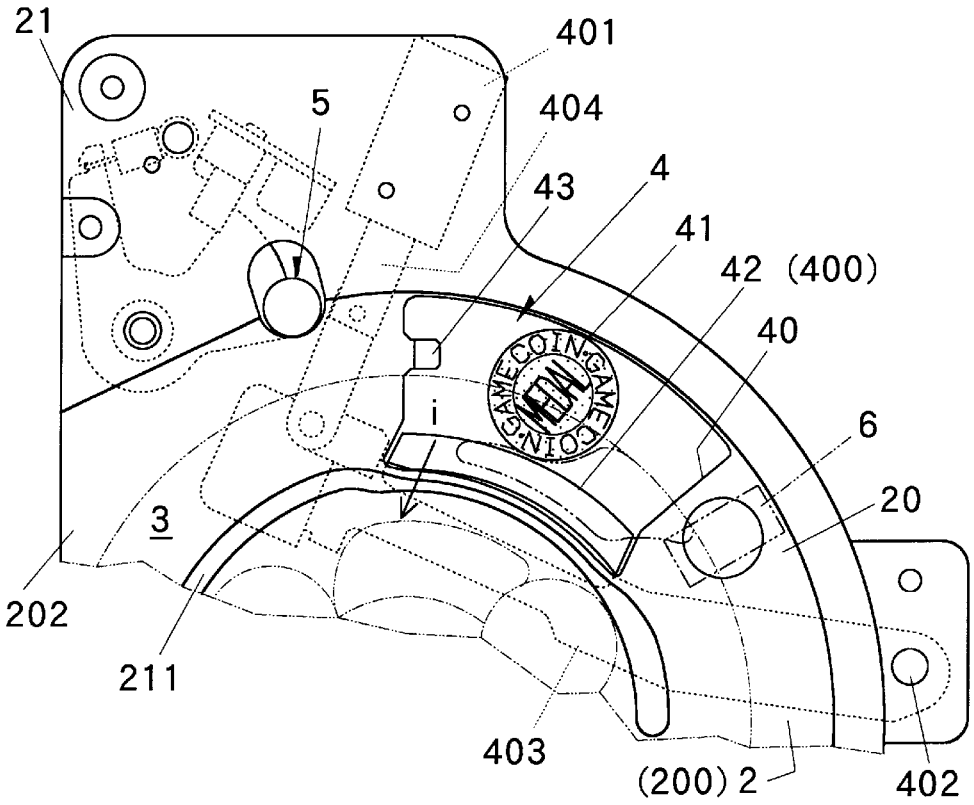
FIG. 18 is an explanatory view showing a ninth action of the same.
Figure 19:
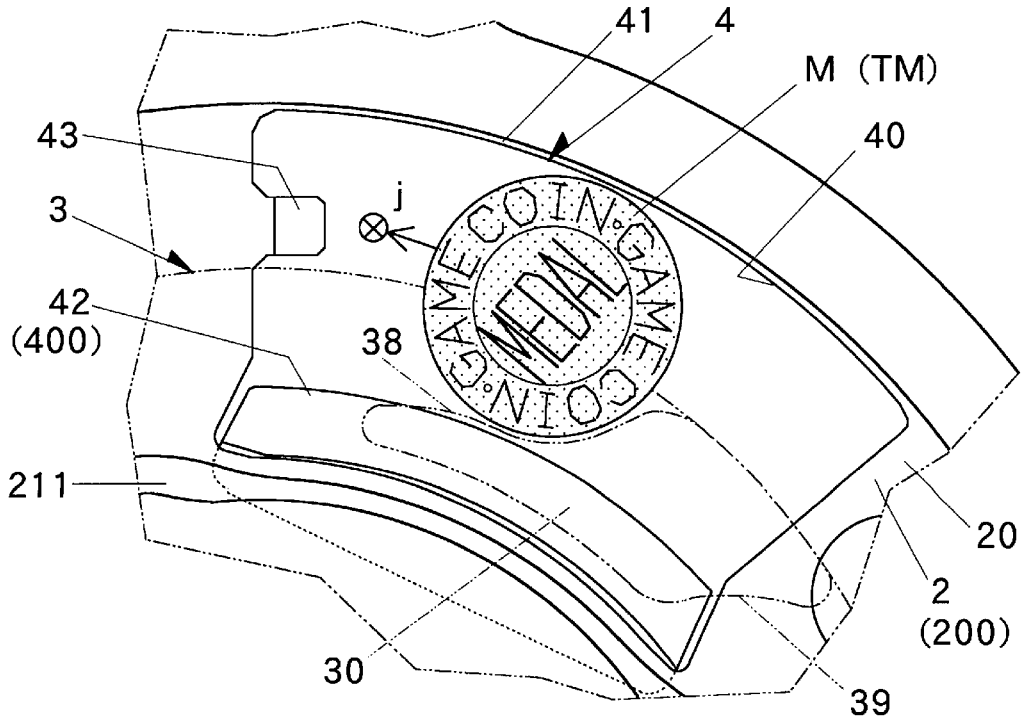
FIG. 19 is an enlarged explanatory view showing a principal part of FIG. 18.

As seen in FIG. 18, when the electricity is off at the solenoid type drive means 401 provided at the coin-selection part 4, the rod 404 which has been retracted with the electricity being on is stretched to shift the second coin supporter 42 forming the movable member 400 (in the direction indicated by the arrow i) to make larger the width of the removal opening 40. When the rotary disc 3 rotates in this instance, all coins including true coins TM and false coins IM can be retrieved to the coin payout opening 73 through the removal opening 40 (as indicated by the arrow j) as shown in FIG. 19.

Figure 20:
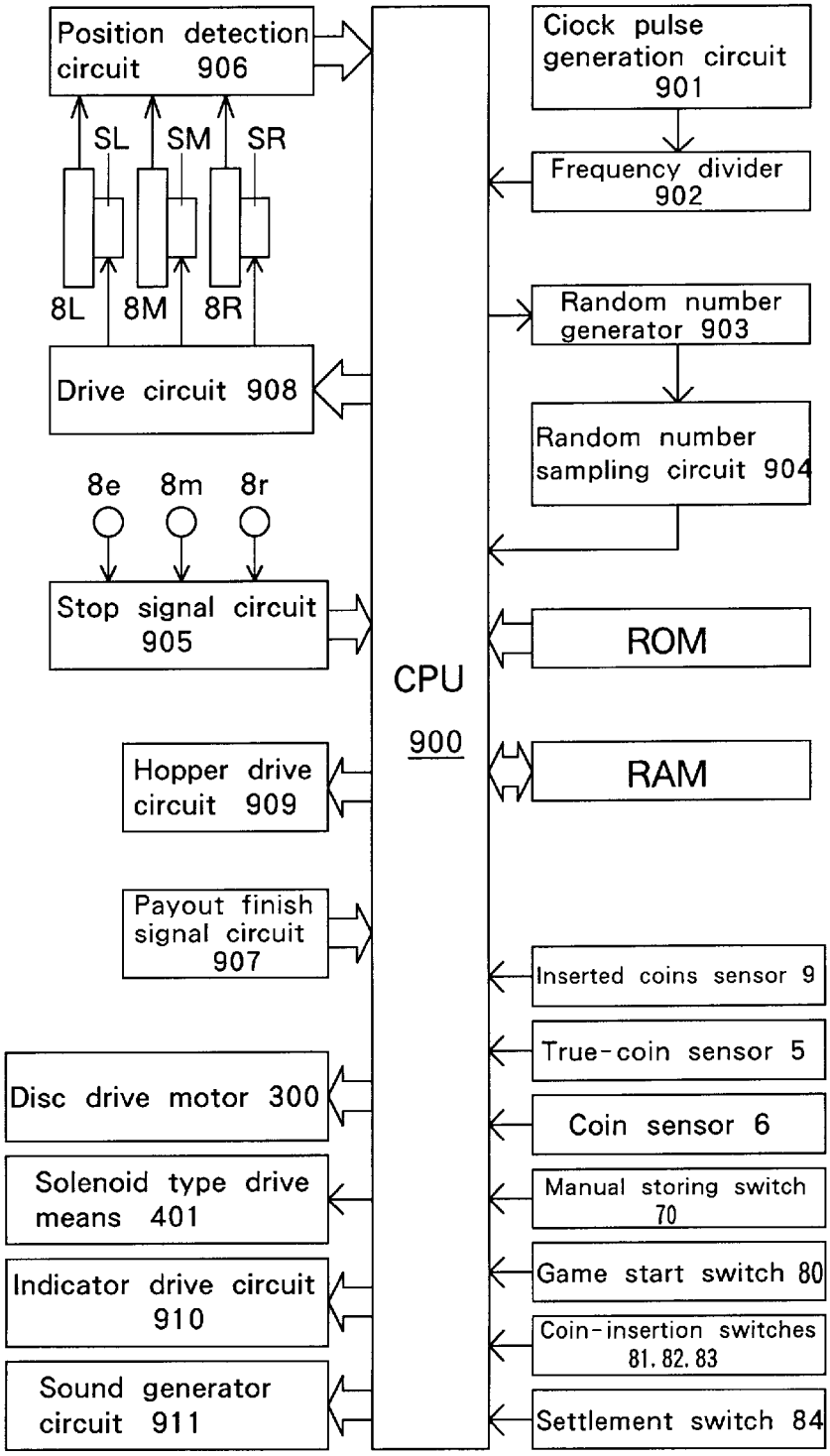
FIG. 20 is a block diagram of control for the game machine including the coin-sending device.

As seen in FIG. 20, the game machine 8 including the coin-sending device 100 is controlled by a control means 900 provided with a microcomputer CPU, read only memory (ROM) and random access memory (RAM). 901 is a clock pulse generation circuit, 902 a frequency divider, 903 a random number generator used in lottery for generating specific features of winnings, and 904 a random number sampling circuit.

Connected to the input side of the CPU are the inserted-coin sensor 9, true-coin sensor 5, coin sensor 6, manual-storing switch 70, game start switch 80, coin-insertion switches (or coin-bet switches) 81, 82 and 83, settlement switch 84, a stop signal circuit 905 from the stop buttons B*e*, 8*m* and 8*r*, a position detector circuit 906 for the reels 8L, 8M and 8R, and a payout finish signal circuit 907 for the coin payout device 72.

Connected to the output side of the CPU are the objects to be controlled, i.e., the drive motor 300 for the rotary disc 3, solenoid type drive means 401 at the coin-selection part 4, a drive circuit 908 for the stepping motors SL, SM, SR for the reels 8L, 8M and BR, a hopper drive circuit 909 for the coin-payout hopper housed in the coin payout device 72, an indicator drive circuit 910, and a sounds generation circuit 911.

Figure 21:
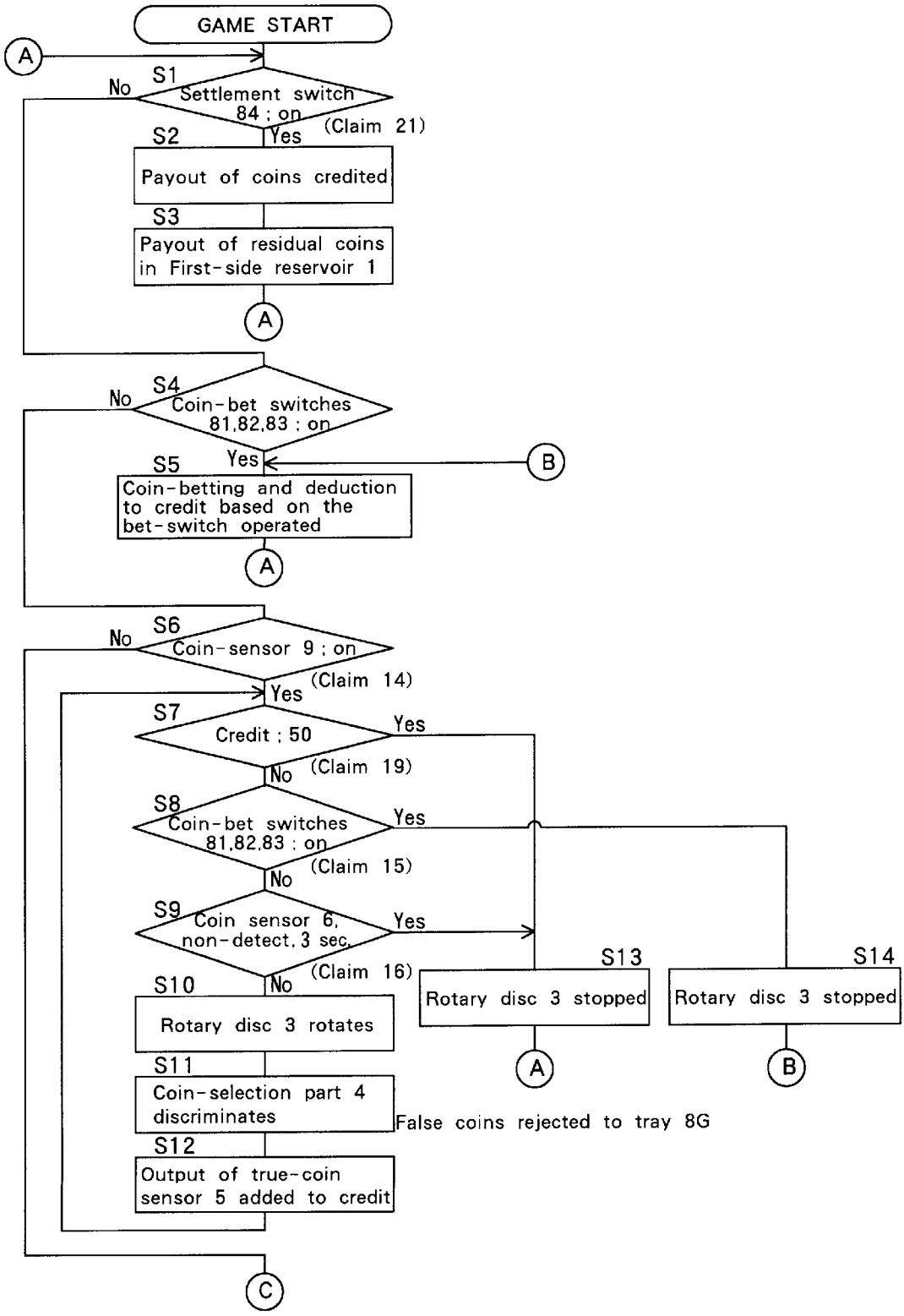
FIG. 21 is a first half of a flow chart of control for the game machine including the coin-sending device.

FIG. 21 shows control by the control means 900 from the start of the game to the end thereof.

In case that the settlement switch 84 is turned on to request coin-payout (the step S1), coins corresponding to the credit are paid out from the coin payout device 72 to the payout tray 8G (S2) and coins remaining in the first-side reservoir 1 are then paid out to the tray 8G (S3), and the control returns to the initial state A. Upon payout of the residual coins, the rotary disc 3 is rotated with the solenoid type drive means 401 being turned off.

In case that the settlement switch is not turned on, when any of the coin-insertion (or bet) switches 81, 82, 83 is turned on (S4), a coin or coins in number corresponding to that switch is or are used or bet from the credit and the credit is subjected to deduction accordingly (S5), and the control returns to the initial state A.

When coins are inserted from the lump-insertion tray 71, the coin sensor 9 is turned on (S6) and the automatic coin-sucking is carried out. Unless any of such events occurs in the midst of the sucking operation that the number of coins in the credit becomes 50 (S7); any of the coin-insertion or bet switches 81, 82, 83 is turned on (SB); or the coin sensor 6 continues non-detecting state for 3 seconds with no coins being actually sent from the rotary disc (S9), the rotary disc 3 continues rotating (S10) and the solenoid type drive means 401 at the coin-selection part 4 is turned on to perform the coin-discrimination (S11). In this case, false coins are rejected to the coin tray 8G while true coins are detected by the true-coin sensor 5 and the credit is subjected to addition accordingly (S12).

When the number of coins in the credit becomes 50 (S7) or the coin sensor 6 is in non-detecting state for 3 seconds (S9), during the automatic sucking operation, the rotary disc 3 is stopped (S13) and the control returns to the initial state A. In case that any of the coin-bet switches 81, 82, 83 is turned on (S8) during the automatic sucking, the rotary disc 3 is stopped (S14) followed by the step S5 in which coins are used or bet from the credit and the credit is given deduction, and the control's return to the initial state A.

Figure 22:
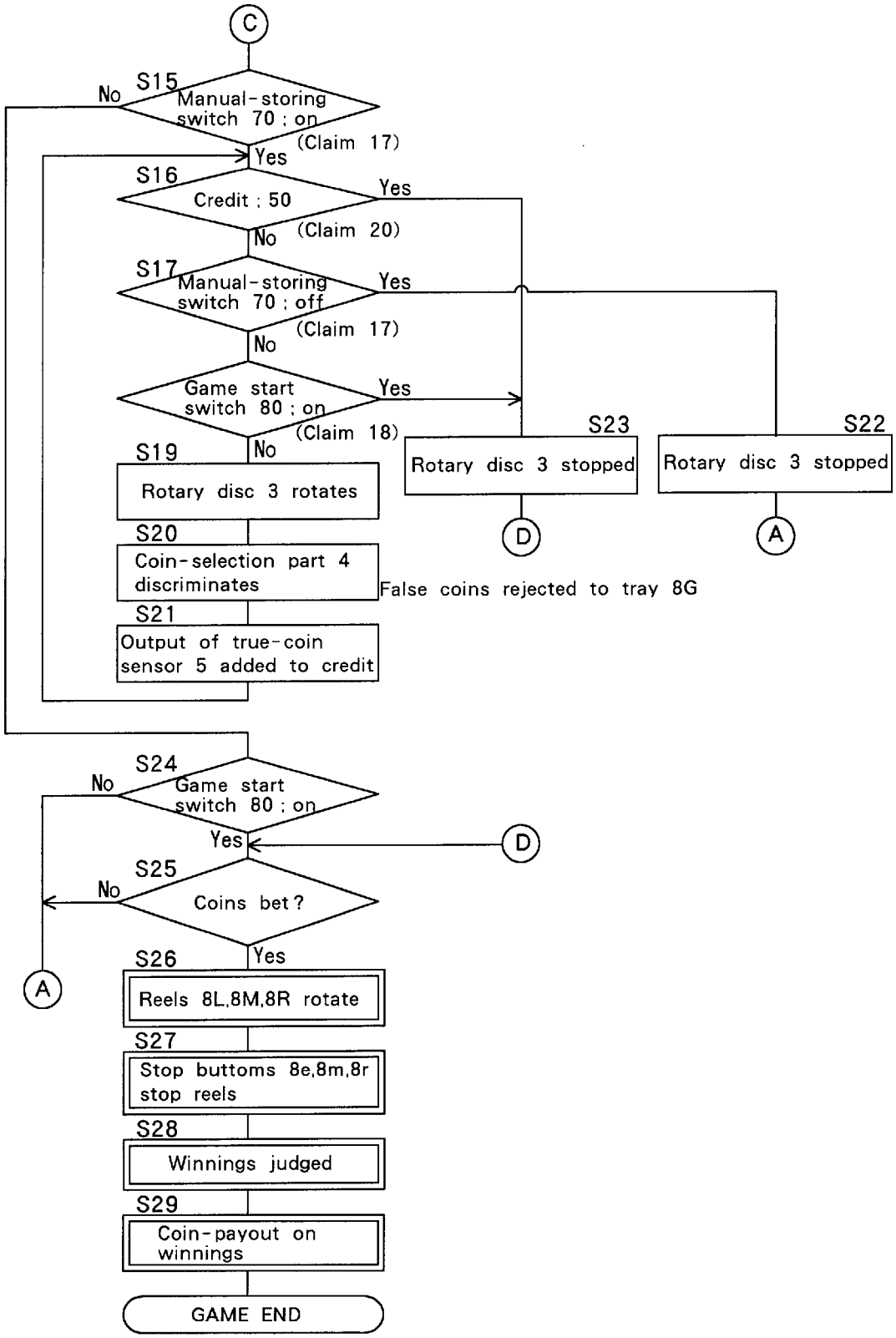
FIG. 22 is a second half of the flow chart of control for the game machine including the coin-sending device.
Figure 23:
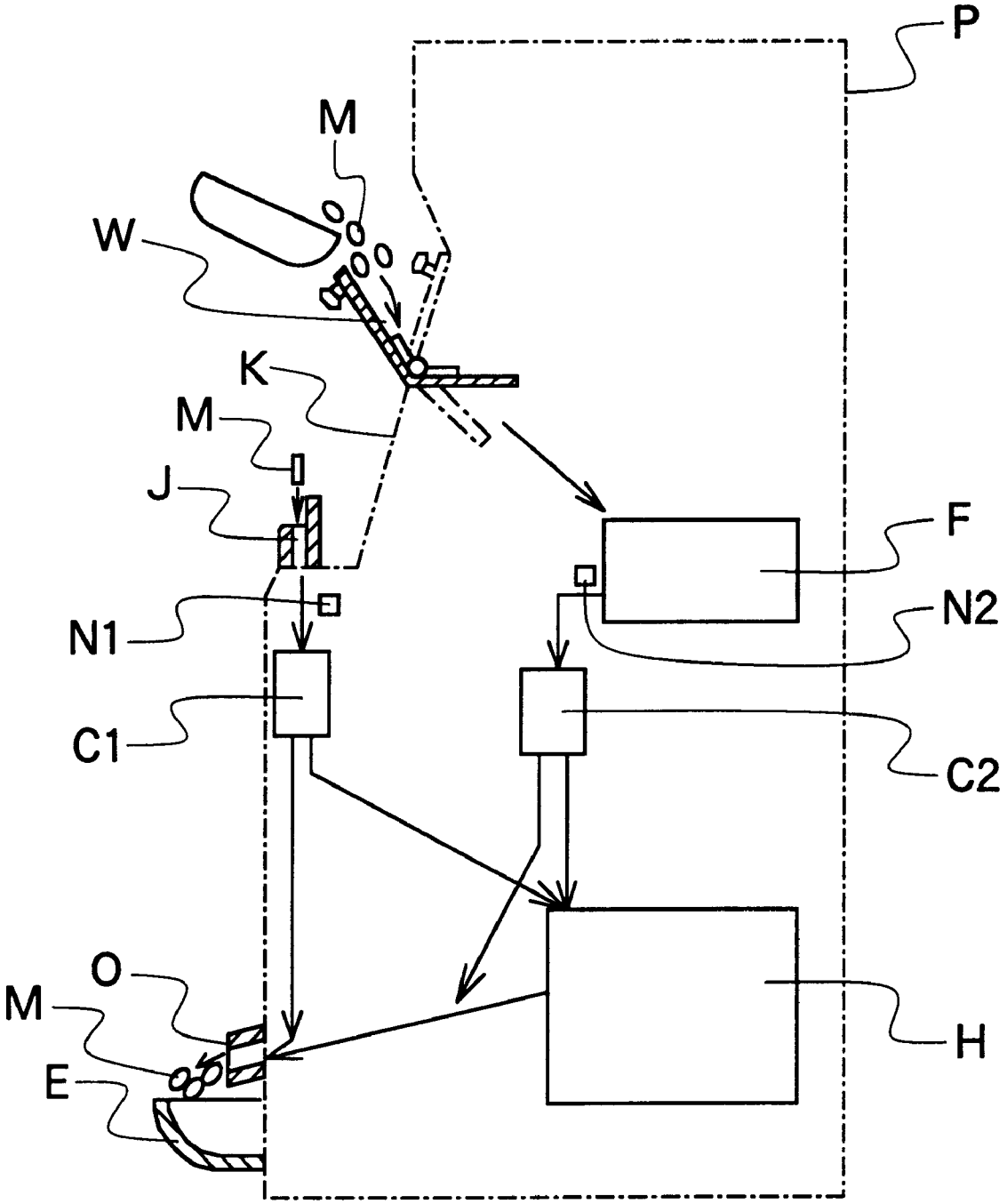
Fig. 23 Prior Art
FIG. 23 is an explanatory view showing the conventional art.

As seen in FIG. 22, when the manual storing switch 70 is turned on (S15) other than the automatic coin-insertion based on the coin sensor 9 turned on, the manually-operated coin-sucking is carried out. Unless any of such events occurs in the midst of the sucking operation that the number of coins in the credit becomes 50 (S16); the manual storing switch 70 is turned off (S17); or the game start switch 80 is turned on (S18), the rotary disc 3 continues rotating (S19) and the solenoid type drive means 401 at the coin-selection part 4 is turned on to perform the coin-discrimination (S20). In this case, false coins are rejected to the coin tray 8G while true coins are detected by the true-coin sensor 5 and the credit is subjected to addition accordingly (S21).

When the manual storing switch 70 is let go of to be turned off (S17) during the manually-operated sucking, the rotary disc 3 is stopped (S22) and the control returns to the initial state A. When the number of coins in the credit becomes 50 (S16) or the game start switch 80 is turned on (S18), during the manually-operated sucking operation, the rotary disc 3 is stopped (S23) and the control jumps over the step S24 (i.e., to the control state D), the step S24 judging "ON" of the game start switch 80.

When the game start switch 80 is turned on (S24) and one, two or three coins are normally bet (S25), rotation of the reels 8L, 8M, 8R (S26), stoppage of the reels by the stop buttons 8*e*, 8*m*, 8*r* (S27), determination of winnings (S28) and coin-payout according to winnings (S29) are executed followed by ending the game. For the coin-payout, any number of coins corresponding to specific winning features are added to the credit or actually paid out from the coin payout device 72 to the tray 8G.

An example of application of the coin-sending device to the game machine 8 has been referred to in the above explanation. The coin-sending device is applicable also to various vending machines, and automatic money-transfer machines and coin-discrimination machines usable in banks, or the like. Moreover, several kinds of coins having different sizes, for example, those in Japanese denominations of 500, 100, 50 and 10 yen, when mixed, can be sorted out into the respective kinds by employing the present invention, in addition to determination or discrimination of true and false coins of the same kind.

In this case, sizes of the holes 34 at the rotary disc 3 and the removal opening 40 at the selection part 4 may be adapted to correspond to standard sizes of those coins to provide a plurality of the components each having the holes 34 and the removal opening 40 in a specific size. The components are aligned vertically, so that coins in a larger diameter are picked up at the component disposed at the top stage and other coins may be sequentially received through the removal openings into the first-side reservoirs on the components placed at the lower stages.

What I claimed is:

1. A coin-sending device comprising a first-side reservoir for storing a number of coins and a rotary disc for sending the coins stored in the reservoir sequentially one by one to a second-side passage, wherein the second-side passage includes a forcible transfer passage in which a transfer force of the rotary disc is applied to coins sent from the rotary disc, and a coin-selection part is provided on the forcible transfer passage to determine or discriminate true and false coins and remove false coins from the passage, wherein the second-side passage includes an arcuate passage extending along the outer periphery of the rotary disc, and wherein a coin-transfer means arranged to contact coins is provided on a rear surface of the rotary disc adjacent to the arcuate passage.

2. A coin-sending device as set forth in claim 1, wherein a true-coin sensor is provided for detecting true coins after passing the coin-selection part.

3. A coin-sending device as set forth in claim 1, wherein the second-side passage comprises a recess which is formed between a base member and a cover member layered thereon and has a height enough to accommodate a thickness of coins.

4. A coin-sending device as set forth in claim 1, wherein the coin-selection part is provided with a coin-removal opening smaller in width than a diameter of true coins and a pair of coin-supporters face the opening and extend along the passage to support an outer peripheral part of true coins.

5. A coin-sending device as set forth in claim 4, wherein a scoop means for scooping coins is provided at a junction between an end of the removal opening and the second-side passage.

6. A coin-sending device as set forth in claim 1, wherein a coin sensor is provided for detecting coins positioned on the second-side passage before being introduced into the coin-selection part.

7. A coin-sending device as set forth in claim 1, wherein the first-side reservoir is provided with an overflow guide through which an excess of stored coins is caused to overflow in a predetermined direction.

8. A coin-sending device as set forth in claim 1, wherein the whole device is slanted with respect to a horizontal plane and an outlet of the second-side passage faces downwards.

9. A coin-sending device as set forth in claim 1, wherein the whole device is incorporated in a game machine which comprises a lump-insertion tray, a coin-payout device, and a coin-payout opening, in such a manner that an inlet of the first reservoir is connected to the tray, the outlet of the second-side passage is connected to the coin-payout device, and the coin-removal opening at the coin-selection part is connected to the coin-payout opening.

10. A coin-sending device as set forth in claim 9, wherein the state of coins placed in the first-side reservoir can be seen from the outside with the coin-sending device being installed in the game machine.

11. A coin-sending device as set forth in claim 12, wherein the coin-selection part is provided with a forcible-discharge mechanism which causes all coins to be discharged through the removal opening according to activation of a settlement switch.

12. A coin-sending device comprising a first-side reservoir for storing a number of coins and a rotary disc for sending the coins stored in the reservoir sequentially one by one to a second-side passage, wherein the second-side passage includes a forcible transfer passage in which a transfer force of the rotary disc is applied to coins sent from the rotary disc, and a coin-selection part is provided on the forcible transfer passage to determine or discriminate true and false coins and remove false coins from the passage, wherein the coin-selection part is provided with a coin-removal opening smaller in width than a diameter of true coins and a pair of coin-supporters face the opening and extend along the passage to support an outer peripheral part of true coins, and wherein one coin-supporter comprises a movable member which changes the removal opening between a state of the opening width smaller than a diameter of true coins and another state of the opening width equal to or larger than the diameter of true coins.

13. A coin-sending device as set forth in claim 12, wherein the movable member is mounted on a swing member which is swingable around a fulcrum by means of a drive means.

14. A coin-sending device comprising a first-side reservoir for storing a number of coins and a rotary disc for sending the coins stored in the reservoir sequentially one by one to a second-side passage, wherein the second-side passage includes a forcible transfer passage in which a transfer force of the rotary disc is applied to coins sent from the rotary disc, and a coin-selection part is provided on the forcible transfer passage to determine or discriminate true and false coins and remove false coins from the passage, wherein the whole device is incorporated in a game machine which comprises a lump-insertion tray, a coin-payout device, and a coin-payout opening, in such a manner that an inlet of the first reservoir is connected to the tray, the outlet of the second-side passage is connected to the coin-payout device, and the coin-removal opening at the coin-selection part is connected to the coin-payout opening, and further comprising a coin-sensor for detecting coins inserted into the lump-insertion tray and a control means for starting the rotary disc in a manner corresponding to an output of the sensor.

15. A coin-sending device as set forth in claim 14, wherein there is included a control means for stopping rotation of the rotary disc in response to operation of coin insertion switches operated for each play.

16. A coin-sending device as set forth in claim 14, wherein there is provided a coin sensor for detecting coins sent from the rotary disc and there is included a control means which stops the rotary disc when a non-detecting state of the coin sensor during rotation of the rotary disc continues over a predetermined time interval.

17. A coin-sending device as set forth in claim 12, wherein there is provided a manual-storing switch and there is included a control means for starting the rotary disc according to whether the switch is turned on and stopping the rotary disc according to whether the switch is turned off.

18. A coin-sending device as set forth in claim 17, wherein there is included a control means for stopping rotation of the rotary disc according to activation of a game-start switch operated in each play.

19. A coin-sending device as set forth in claim 14, wherein there is included a control means for stopping rotation of the rotary disc when the number of true coins taken out of the outlet of the second-side passage to be credited reaches a predetermined number.

20. A coin-sending device as set forth in claim 17, wherein there is included a control means for stopping rotation of the rotary disc when the number of true coins taken out of the outlet of the second-side passage (2) to be credited reaches a predetermined number.

* * * * *